US008910428B2

(12) United States Patent
Rule et al.

(10) Patent No.: US 8,910,428 B2
(45) Date of Patent: Dec. 16, 2014

(54) STORAGE BUILDING AND A ROOF PANEL SYSTEM FOR USE WITH STORAGE BUILDINGS

(71) Applicants: James J. Rule, Morton, IL (US); Gregg Wallner, Lincoln, IL (US); James Aikman, Lincoln, IL (US)

(72) Inventors: James J. Rule, Morton, IL (US); Gregg Wallner, Lincoln, IL (US); James Aikman, Lincoln, IL (US)

(73) Assignee: The ShedQuarters, Inc., East Peoria, IL (US)

( * ) Notice: Subject to any disclaimer, the term of this patent is extended or adjusted under 35 U.S.C. 154(b) by 0 days.

(21) Appl. No.: 13/803,654

(22) Filed: Mar. 14, 2013

(65) Prior Publication Data

US 2014/0259981 A1 Sep. 18, 2014

(51) Int. Cl.

| | |
|---|---|
| ***E04H 1/00*** | (2006.01) |
| ***E04D 1/30*** | (2006.01) |
| ***E04D 1/34*** | (2006.01) |
| ***E04D 13/147*** | (2006.01) |

(52) U.S. Cl.

CPC ..... *E04D 1/30* (2013.01); *E04D 1/3402* (2013.01); *E04D 13/147* (2013.01)

USPC ..... 52/79.5; 52/92.2; 52/272; 52/79.12; 52/483.1

(58) Field of Classification Search

CPC . E04B 1/343; E04B 1/34315; E04B 1/34331; E04B 1/34326; E04B 7/00; E04B 7/02; E04B 7/026; E04B 7/04; E04C 2/38; E04C 2/44

USPC ..... 52/79.1, 92.1, 92.2, 93.1, 272, 284, 52/79.5, 79.12

See application file for complete search history.

(56) References Cited

U.S. PATENT DOCUMENTS

| | | | | |
|---|---|---|---|---|
| 506,732 | A * | 10/1893 | Scheidler | 52/92.1 |
| 2,350,904 | A * | 6/1944 | King | 52/64 |
| 4,894,964 | A * | 1/1990 | Thrift et al. | 52/93.1 |
| 5,209,030 | A * | 5/1993 | Sloditskie et al. | 52/79.5 |
| 7,464,502 | B2 * | 12/2008 | Sardi Herrera | 52/79.5 |
| 8,505,246 | B1 * | 8/2013 | Cadorath | 52/79.6 |

* cited by examiner

*Primary Examiner* — William Gilbert
*Assistant Examiner* — Patrick Maestri
(74) *Attorney, Agent, or Firm* — Howard & Howard Attorneys PLLC

(57) ABSTRACT

A roof panel system for use with a portable building is described herein. The portable building includes a support frame including a first wall plate, an opposite second wall plate, and a ridge beam positioned above the first and second wall plates. The ridge beam and the first and second wall plates extend between the first end wall and the second end wall along a longitudinal axis. The roof panel system includes a first panel assembly adapted to be coupled between the ridge beam and the first wall plate and a second panel assembly adapted to be coupled between the ridge beam and the second wall plate. Each of the first and second panel assemblies includes a plurality of pre-assembled, modular roof panels that are adapted to be coupled together to form the first panel assembly and second panel assembly, respectively.

36 Claims, 20 Drawing Sheets

STORAGE BUILDING AND A ROOF PANEL SYSTEM FOR USE WITH STORAGE BUILDINGS

TECHNICAL FIELD

The subject matter disclosed herein relates generally to portable storage buildings, and more particularly, to a storage building and a roof panel system for use with storage buildings.

BACKGROUND OF THE INVENTION

Portable storage buildings are widely used for commercial and industrial use to provide temporary buildings for use in storing goods and equipment. Known portable storage buildings include a frame assembly that includes sidewalls extending upwardly from a floor, and a roof truss that extends upwardly from the sidewalls for supporting a roof thereon. The roof includes a plurality of plywood sheets that are coupled to the roof truss to form the building roof. At least some known truss systems are assembled as part of the building frame. Because known truss systems are assembled with the building frame, a consumer may have difficulty in assembling a portable storage building without the assistance of a building contractor and/or building manufacturer. Thus, the cost of assembling a portable building is increased.

Accordingly, new features are necessary to reduce the complexity of assembling a portable storage building and to enable a consumer to assemble at least a portion of the storage building to reduce the overall cost of the building. The present invention is directed to satisfying these needs.

SUMMARY OF THE INVENTION

In one aspect of the present invention, a pre-assembled panel for use in roof panels of a portable storage building is provided.

In one aspect of the present invention, a roof panel system for use with a portable building is provided. The portable building includes a support frame including a first end wall, a second end wall, a first wall plate, an opposite second wall plate, and a ridge beam positioned above the first and second wall plates. The ridge beam and the first and second wall plates extend between the first end wall and the second end wall along a longitudinal axis. The roof panel system includes a first panel assembly adapted to be coupled between the ridge beam and the first wall plate and a second panel assembly adapted to be coupled between the ridge beam and the second wall plate. Each of the first and second panel assemblies includes a plurality of roof panels that are adapted to be coupled together to form the first panel assembly and second panel assembly, respectively. Each first panel assembly and second panel assembly is adapted to extend between the first end wall and the second end wall.

In another aspect of the present invention, a portable storage building is provided. The portable storage building includes a support frame and a roof panel system that is coupled to the support frame. The support frame includes a first end wall, a second end wall, a first wall plate, an opposite second wall plate, and a ridge beam that is positioned above the first and second wall plates. The ridge beam and the first and second wall plates extend between the first end wall and the second end wall along a longitudinal axis. The roof panel system includes a first panel assembly that is coupled between the ridge beam and the first wall plate and a second panel assembly that is coupled between the ridge beam and the second wall plate. Each of the first and second panel assemblies include a plurality of roof panels that are coupled together to form the first panel assembly and second panel assembly, respectively. Each first panel assembly and second panel assembly extend between the first end wall and the second end wall.

In yet another embodiment, a method of assembling a roof panel system for use with a portable building is provided. The portable building includes a support frame. The roof panel system is adapted to be coupled to the building support frame. The method includes providing a plurality of pre-assembled roof panels, wherein each roof panel is adapted to be coupled to the building support frame and/or adjacent roof panels to form the roof panel system. A roof plate is provided to form the roof panel. The roof plate has a forward edge, a rear edge, a first side edge and an opposite second side edge. Each of the first and second side edges extend between the forward edge and the rear edge. The roof panel has a length measured between the forward edge and the rear edge along a longitudinal axis. The method includes coupling an upper support beam to the roof plate. The upper support beam is orientated adjacent to the first side edge and extends from the forward edge towards the rear edge along the longitudinal axis. The method also includes coupling a lower support beam to the roof plate to form the roof panel. The lower support beam is orientated adjacent to the second side edge and extends from the forward edge towards the rear edge substantially parallel to the upper support beam.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

With reference to the drawings and in operation, the present invention overcomes at least some of the disadvantages of known portable storage buildings by providing a roof panel system that is assembled from a plurality of modular roof panels. The modular roof panels may be pre-assembled, e.g., prior to delivery to the assembly side. More specifically, the roof panels include a roof plate and support members that are adapted to be coupled to a building support frame to form a roof of the building. Each roof panel has a predefined size and shape to enable a consumer to assemble the building roof on-site. Moreover, each roof panel is adapted to be coupled to adjacent roof panels to form the roof panel system. By providing a portable storage building with a roof panel system that can be assembled by the consumer using pre-assembled roof panels, the manpower required to assemble the portable building is reduced, thus reducing the overall cost of portable storage buildings.

In general, the portable storage building 10 includes a roof panel system 12 that includes a plurality of modular, preassembled roof panels 60 (see below) that each have a predefined shape and are sized and shaped to be coupled together to form the roof of the portable storage building 10. In addition, the roof panels 60 are sized and shaped to be coupled to a building support frame to enable a consumer to assemble the building roof without the assistance of a contractor.

Figure 1:
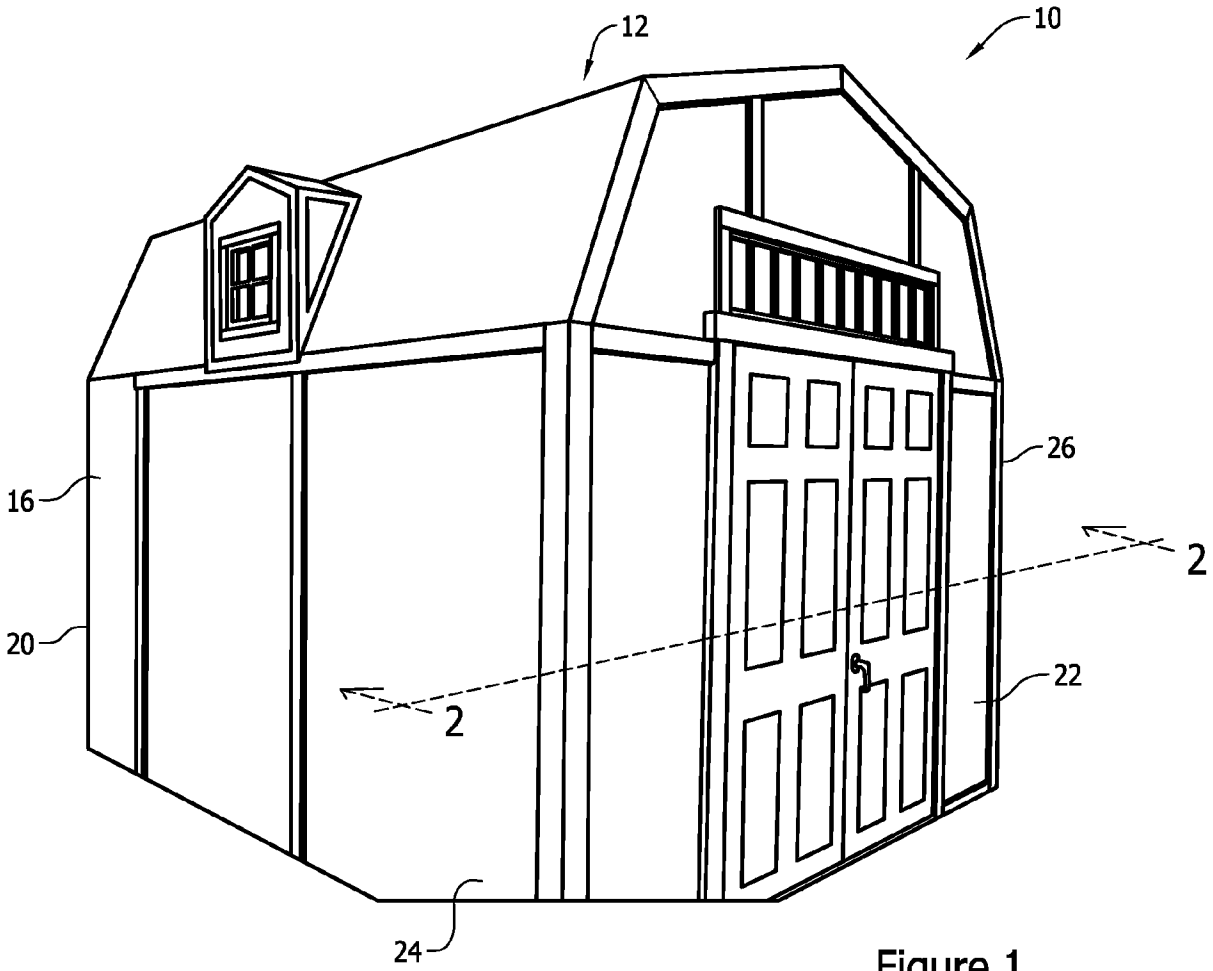
FIG. 1 is a perspective view of a portable storage building including a roof panel system, according to an embodiment of the present invention.
Figure 2:
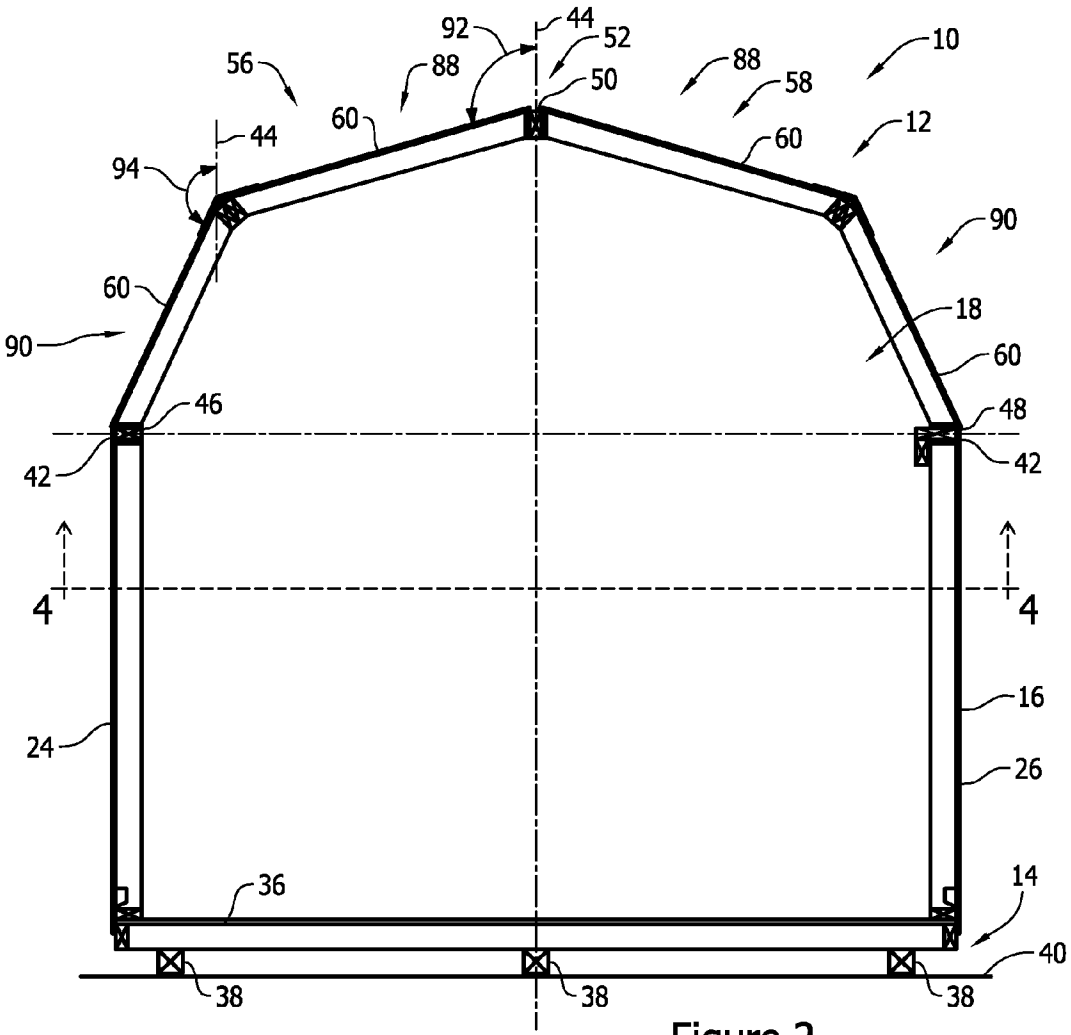
FIG. 2 is a schematic view of the portable storage building shown in FIG. 1, and taken along line 2-2.
Figure 3:
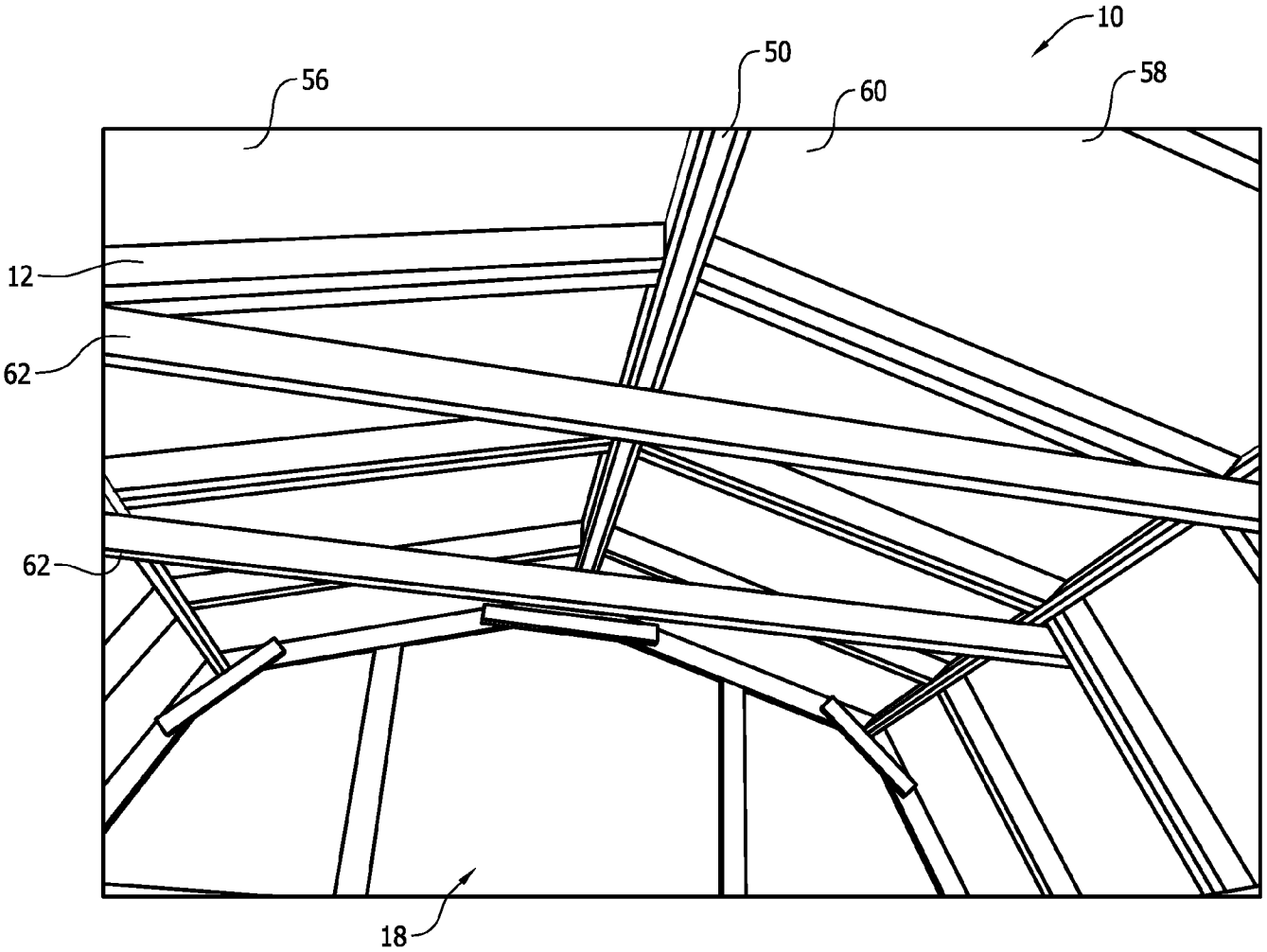
FIG. 3 is a perspective view of the roof panel system shown in FIG. 1, according to an embodiment of the present invention.
Figure 4:
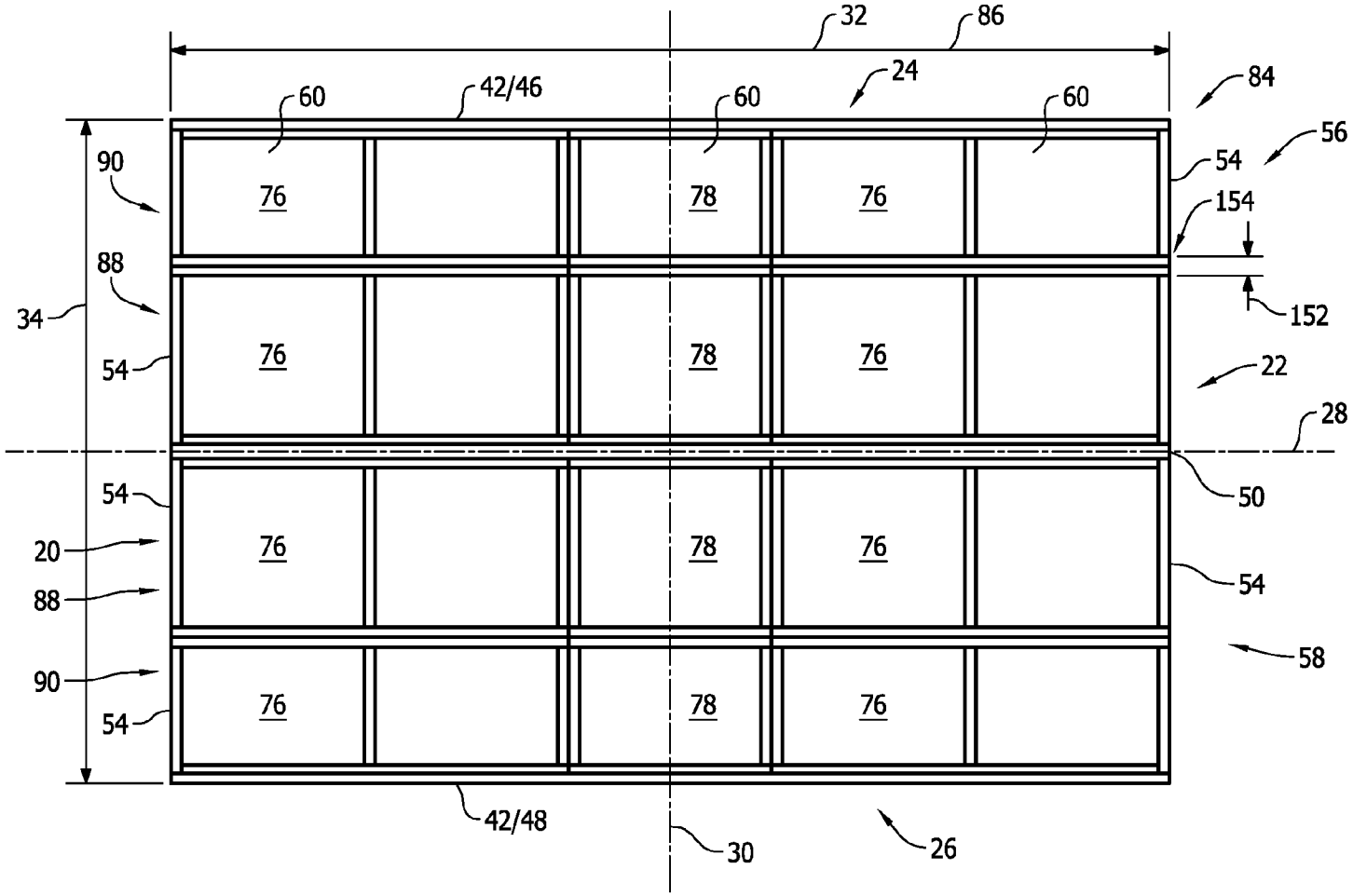
FIG. 4 is a schematic view of the roof panel system shown in FIG. 2, and taken along the line 4-4, according to an embodiment of the present invention.
Figure 5:
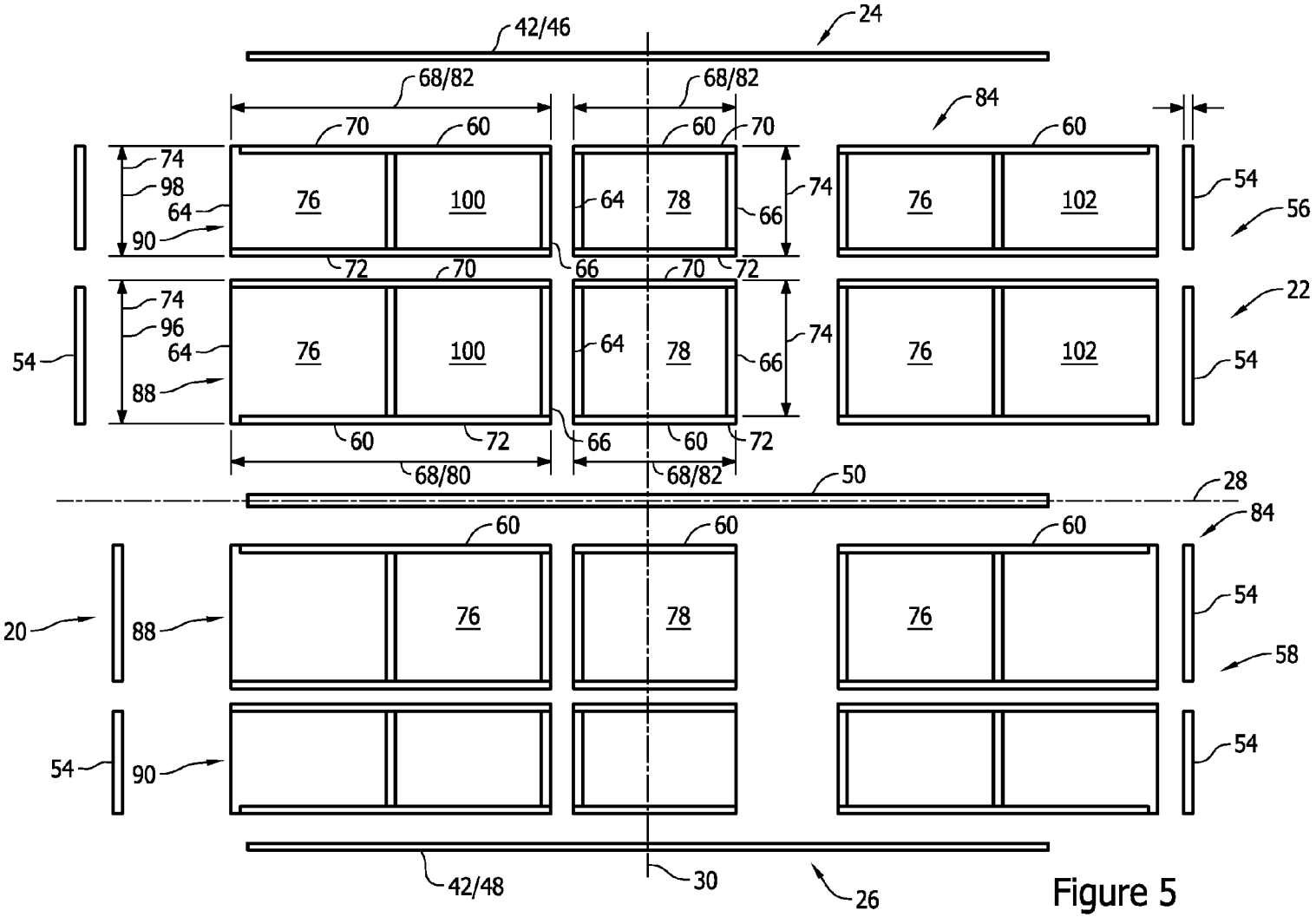
FIG. 5 is an exploded schematic view of the roof panel system shown in FIG. 4.

FIG. 1 is a perspective view of the portable storage building 10 including the roof panel system 12. FIG. 2 is a schematic view of the portable storage building 10 taken along line 2-2 shown in FIG. 1. FIG. 3 is a perspective view of the roof panel system 12. FIG. 4 is a schematic view of the roof panel system 12 taken along line 4-4 shown in FIG. 2. FIG. 5 is an exploded schematic view of the roof panel system 12 as is shown in FIG. 4. In the illustrated embodiment, the portable storage building 10 includes a floor assembly 14, a support frame 16 that is coupled to the floor assembly 14, and the roof panel system 12 that is adapted to be coupled to the support frame 16 to define an interior volume 18 of the portable storage building 10. In one embodiment, the portable storage building 10 may be a portable storage shed that may be assembled and reassembled and transported from one location to another location. In one embodiment, the portable storage building 10 is a storage shed, commercially available from The Shed-Quarters, Inc., East Peoria, Ill. It should be noted that the portable storage building 10 is exemplary only, and that the present invention is not limited to being used only with the portable storage building 10, but rather may instead be implemented within any building that functions as described herein.

In the illustrated embodiment, the support frame 16 includes a first end wall 20, a second end wall 22, a first sidewall 24, and an opposite second side wall 26. The first sidewall 24 and the second sidewall 26 each extend between the first end wall 20 and the second end wall 22 along a longitudinal axis 28 (shown in FIG. 4). The first end wall 20 and the second end wall 22 each extend between the first and second sidewalls 24 and 26 along a transverse axis 30 that is substantially perpendicular to the longitudinal axis 28. The portable storage building 10 has a length 32 measured between the endwalls 20 and 22 along the longitudinal axis 28, and a width 34 measured between the sidewalls 24 and 26 and along the transverse axis 30. For example, in one embodiment, the portable storage building 10 may have a width 34 approximately equal to 12' and a length 32 approximately equal to 12' (a "12'×12'" footprint). Alternative, other building footprints may be used such as, for example, an 8'×8', 8'×10', 8'×12', 10'×8', 10'×10', 10'×12', 12'×16', or any other suitable building sizes.

In the illustrated embodiment, the floor assembly 14 is coupled to the support frame 16 and includes a floor plate 36 and a plurality of support rails 38 that are coupled to the floor plate 36 for supporting the portable building 10 from a supporting surface 40. The sidewalls 24 and 26 each include a wall plate 42 that is spaced above the floor assembly 14 along a vertical axis 44. More specifically, the first sidewall 24 includes a first wall plate 46 and the second sidewall 26 includes a second wall plate 48.

In the illustrated embodiment, the support frame 16 also includes a ridge beam 50 that is positioned above the first and second wall plates 46 and 48 along the vertical axis 44. The ridge beam 50 extends between the first end wall 20 and the second end wall 22 along the longitudinal axis 28 to form a peak 52 of the portable storage building 10. In one embodiment, the endwalls 20 and 22 each include at least one roof support beam 54 that is adapted to be coupled to the roof panel system 12 to support the roof panel system 12 from the support frame 16. In one embodiment, the roof support beam 54 may be coupled to the ridge beam 50 and/or the first and second wall plates 46 and 48, respectively.

In the illustrated embodiment, the roof panel system 12 includes a first panel assembly 56 and a second panel assembly 58. The first panel assembly 56 and the second panel assembly 58 each extend between the first end wall 20 and the second end wall 22 along the longitudinal axis 28. Each first and second panel assembly 58 is adapted to be coupled between the ridge beam 50 and the first and second sidewalls 24 and 26, respectively. More specifically, the first panel assembly 56 is coupled between the ridge beam 50 and the first wall plate 46, and the second panel assembly 58 is coupled between the ridge beam 50 and the second wall plate 48. Each of the first and second panel assemblies 56 and 58 include a plurality of pre-assembled, modular roof panels 60 that are adapted to be coupled together to form the first panel assembly 56 and second panel assembly 58, respectively. In one embodiment, the support frame 16 may include one or more support beams 62 that are coupled to the first panel assembly 56 and the second panel assembly 58.

In the illustrated embodiment, each roof panel 60 extends between a first end 64 and a second end 66 and includes a length 68 measured between the first end 64 and the second end 66 along longitudinal axis 28. In addition, each roof panel 60 extends between a first side 70 and a second side 72 and includes a width 74 measured between the first side 70 and the second side 72 along the transverse axis 30. In the illustrated embodiment, the plurality of roof panels 60 includes a primary roof panel 76 and a secondary roof panel 78. The primary roof panel 76 has a first length 80, and the secondary roof panel 78 has a second length 82 that is less than the first length 80. In one embodiment, the first length 80 may be twice as long as the second length 82. For example, in one embodiment, the primary roof panel 76 may have a first length 80 that is approximately equal to 48" or 4 ft, and the secondary roof panel 78 may have a second length 82 that is approximately equal to 24" or 2 ft. Alternatively, the primary roof panel 76 and the secondary roof panel 78 may have any suitable length to enable the roof panel system 12 to function as described herein. In addition, in one embodiment, the primary roof panel 76 and the secondary roof panel 78 may each have a width 74 that is approximately equal to 65½". Alternatively, each primary and secondary roof panel 76 and 78 may have any suitable width 74 to enable the roof panel system 12 to function as described herein.

In the illustrated embodiment, the first and second roof panel assemblies 56 and 58 each include a combination 84 of roof panels 60 that are coupled together along the longitudinal axis 28 to define a total length 86 of the roof panel system 12. More specifically, roof panels 60 orientated along the longitudinal axis 28 are coupled together such that a roof panel second end 66 is coupled to an adjacent roof panel first end 64 to define the roof panel system total length 86. Moreover, the combination 84 of roof panels 60 is selected such that the sum of the panel lengths 68 is approximately equal to the building length 32. In the illustrated embodiment, each roof panel assembly 56 and 58 includes a combination 84 of primary roof panels 76 and/or secondary roof panels 78 that are selected based on the building length 32. For example, in one embodiment, wherein the primary roof panel 76 has a first length 80 that is approximately equal to 4 ft, and the secondary roof panel 78 has a second length 82 that is approximately equal to 2 ft, if the portable storage building 10 includes a 10'×10' footprint, the corresponding roof panel system 12 would include 2 primary roof panels 76 and 1 secondary roof panel 78 such that the total length of the adjacent roof panels 60 is approximately equal to 10'. Moreover, if the portable storage building 10 includes an 8'×8' footprint, the roof panel system 12 may include a combination having 2 primary roof panels 76 each having a length of 48".

In the illustrated embodiment, the first panel assembly 56 and the second panel assembly 58 each include a first set 88 of roof panels 60 and a second set 90 of roof panels 60. The first set 88 includes a plurality of adjacent roof panels 60 that are coupled to the ridge beam 50 and extend outwardly from the ridge beam 50 at a first oblique angle 92 that is measured with respect to the vertical axis 44. The second set 90 includes a plurality of adjacent roof panels 60 that are coupled between the first set 88 and the corresponding wall plate 42, and extend outwardly from the first set 88 towards the corresponding wall plate 42 at a second angle 94 that is measured with respect to the vertical axis 44. In the illustrated embodiment, the second angle 94 is larger than the first angle 92. In another embodiment, the second angle 94 may be approximately equal to the first angle 92. In addition, the first set 88 has a first width 96 measured along the transverse axis 30, and the second set 90 has a second width 98 measured along the transverse axis 30. In the illustrated embodiment, the first width 96 is longer than the second width 98. Alternatively, the first width 96 may be less than, or equal to the second width 98.

In the illustrated embodiment, the first set 88 includes a first primary roof panel 100 that is coupled to the first end wall 20 and a second primary roof panel 102 that is coupled to the second end wall 22. A secondary roof panel 78 is coupled between the first primary roof panel 100 and the second primary roof panel 102. Similarly, the second set 90 includes a first primary roof panel 100 that is coupled to the first end wall 20, a second primary roof panel 102 that is coupled to the second end wall 22, and a secondary roof panel 78 coupled to the first primary roof panel 100 and the second primary roof panel 102. Alternatively, the first and second primary roof panels 100 and 102 may be coupled together and the secondary roof panel 78 may be coupled to the first end wall 20 or the second end wall 22. In the illustrated embodiment, each roof panel 60 of the first set 88 is coupled to a corresponding roof panel 60 of the second set 90 such that the first primary roof panels 100 are coupled together, the secondary roof panels 78 are coupled together, and the second primary roof panels 102 are coupled together to form the first and second panel assemblies 56 and 58, respectively.

Figure 13:
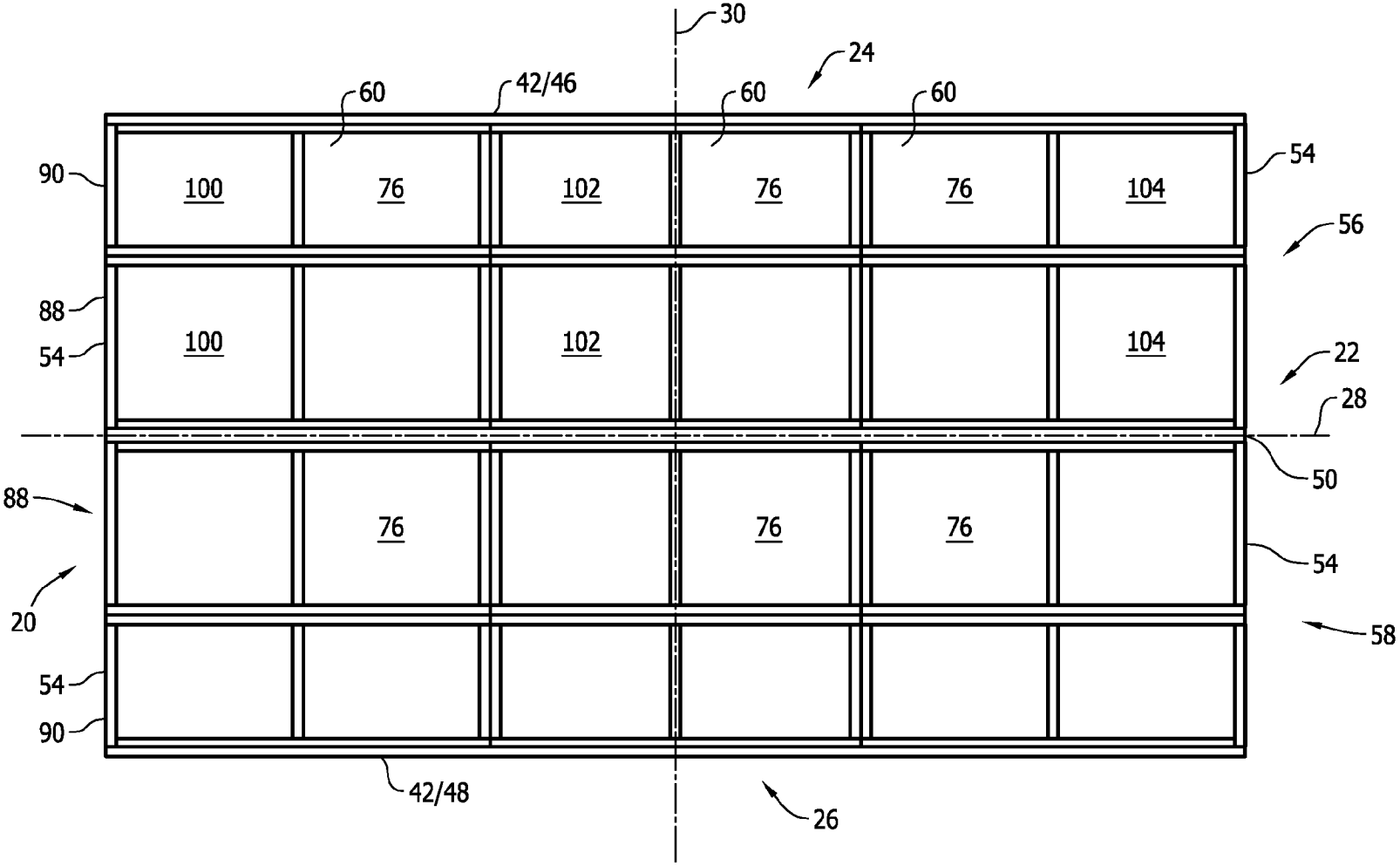
FIG. 13 is schematic view of another embodiment of the roof panel system shown in FIG. 4, according to an embodiment of the present invention.
Figure 14:
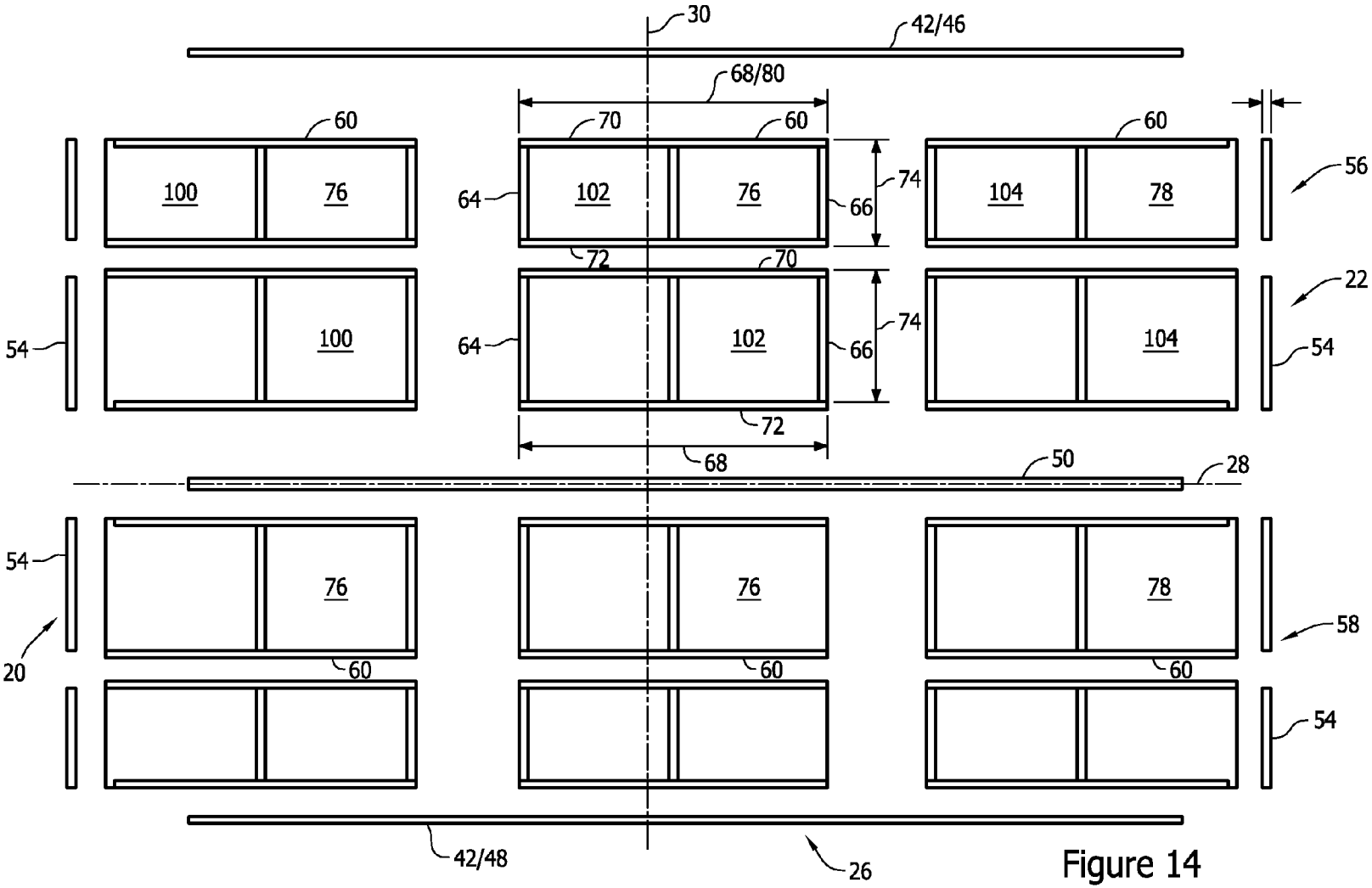
FIG. 14 is an exploded schematic view of the roof panel system shown in FIG. 13.

FIG. 13 is a schematic view of another embodiment of the roof panel system 12, and FIG. 14 is an exploded schematic view of the roof panel system 12 as is shown in FIG. 13. In the illustrated embodiment, the first set 88 and the second set 90 each include a first primary roof panel 100, a second primary roof panel 102, and a third primary roof panel 104 that are coupled together along the longitudinal axis 28.

Figure 6:
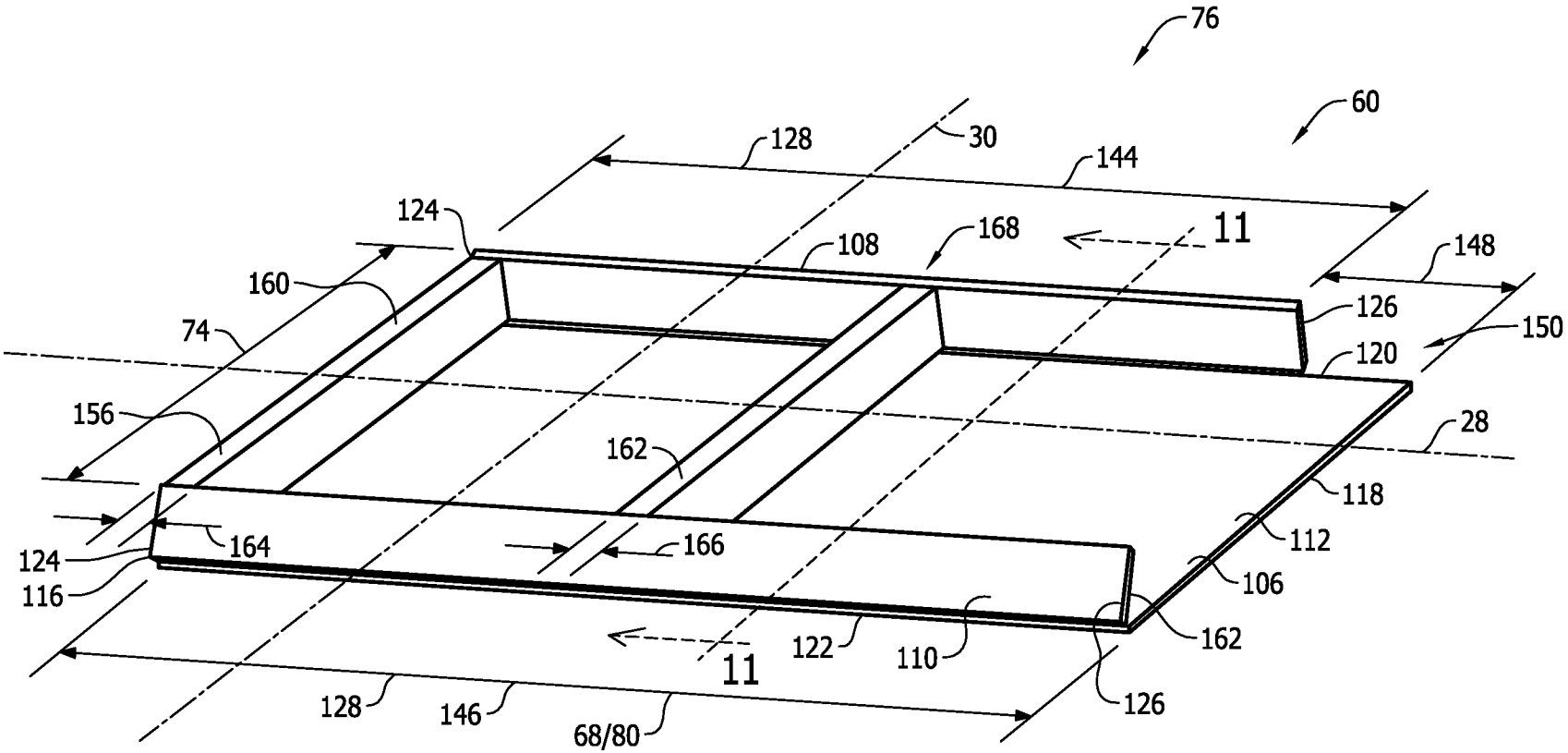
FIG. 6 is a schematic view of a roof panel that may be used with the roof panel system shown in FIGS. 1-5 and FIGS. 13-20, according to an embodiment of the present invention.
Figure 7:
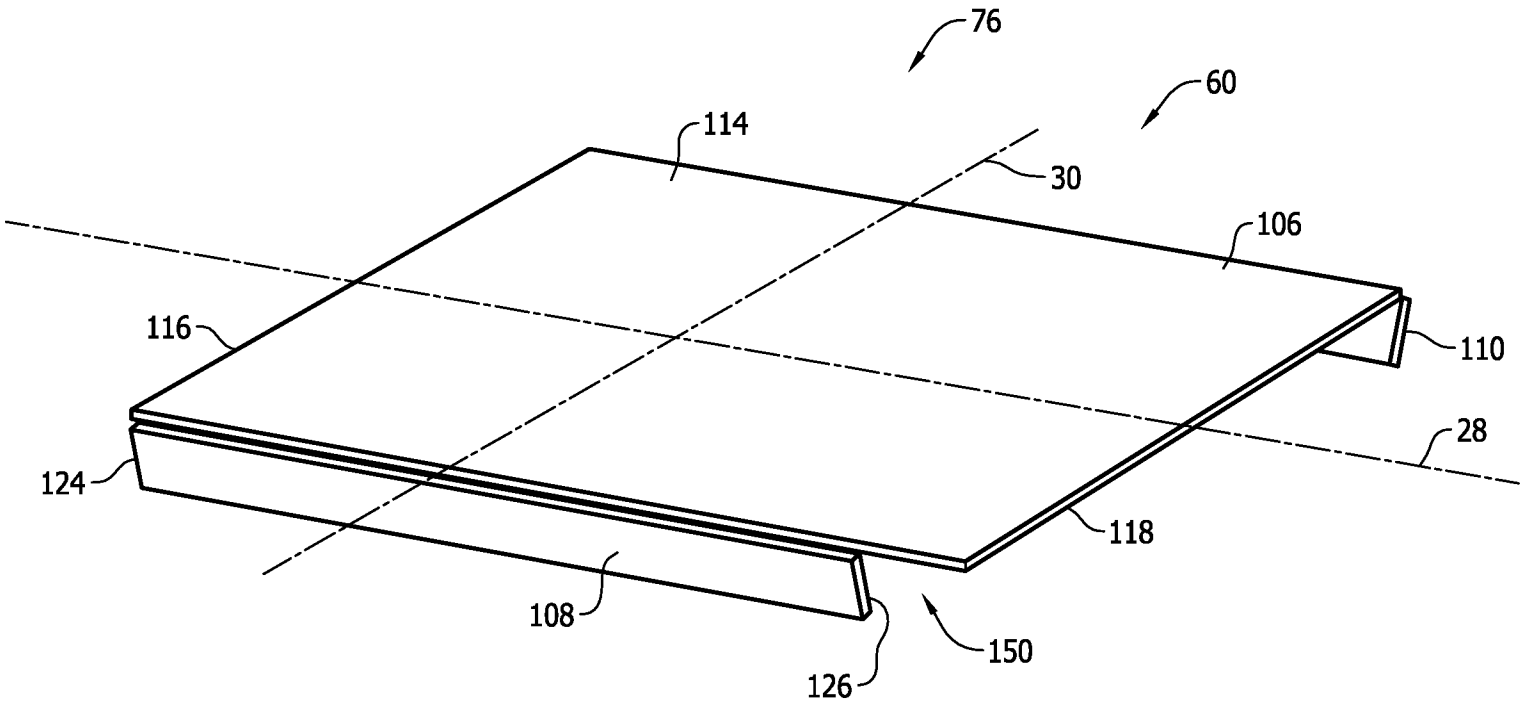
FIG. 7 is another schematic view of the roof panel shown in FIG. 6.
Figure 8:
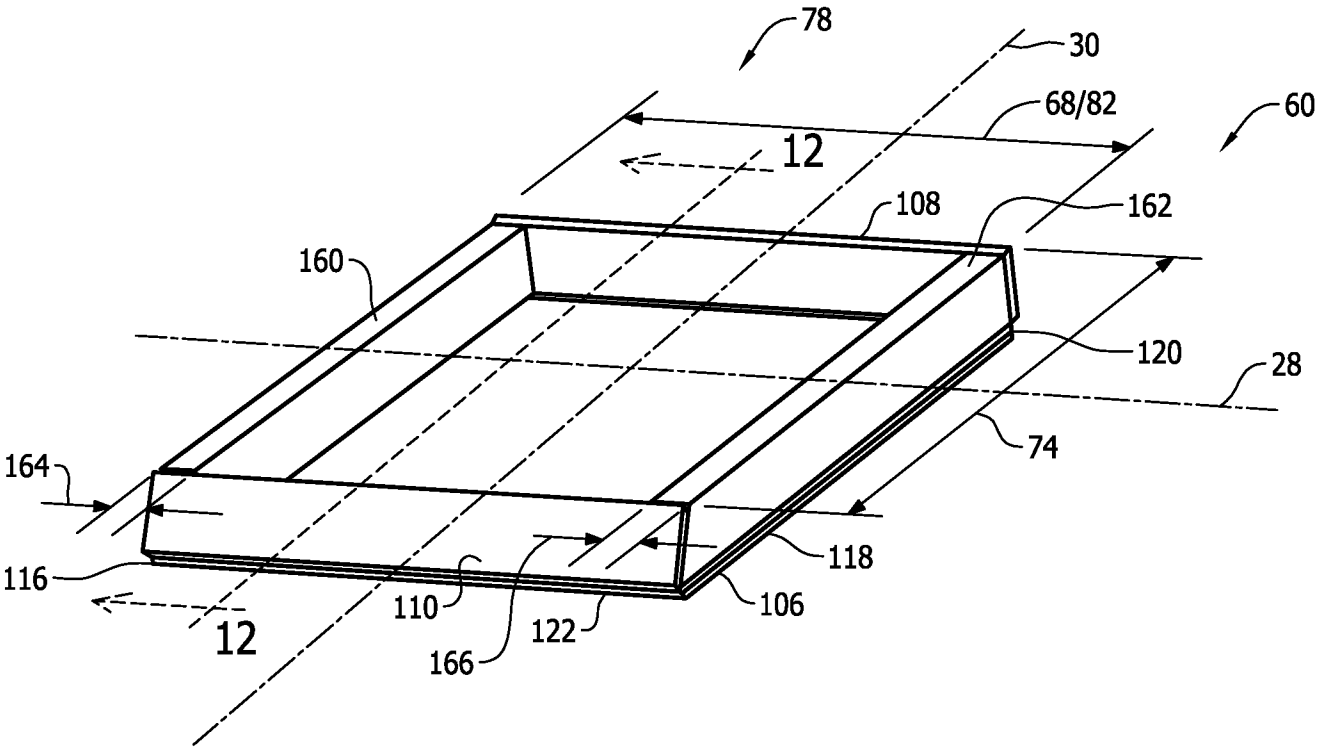
FIGS. 8-10 are schematic views of roof panels that may be used with the roof panel system shown in FIGS. 2-6 and FIGS. 13-20, according to an embodiment of the present invention.
Figure 11:
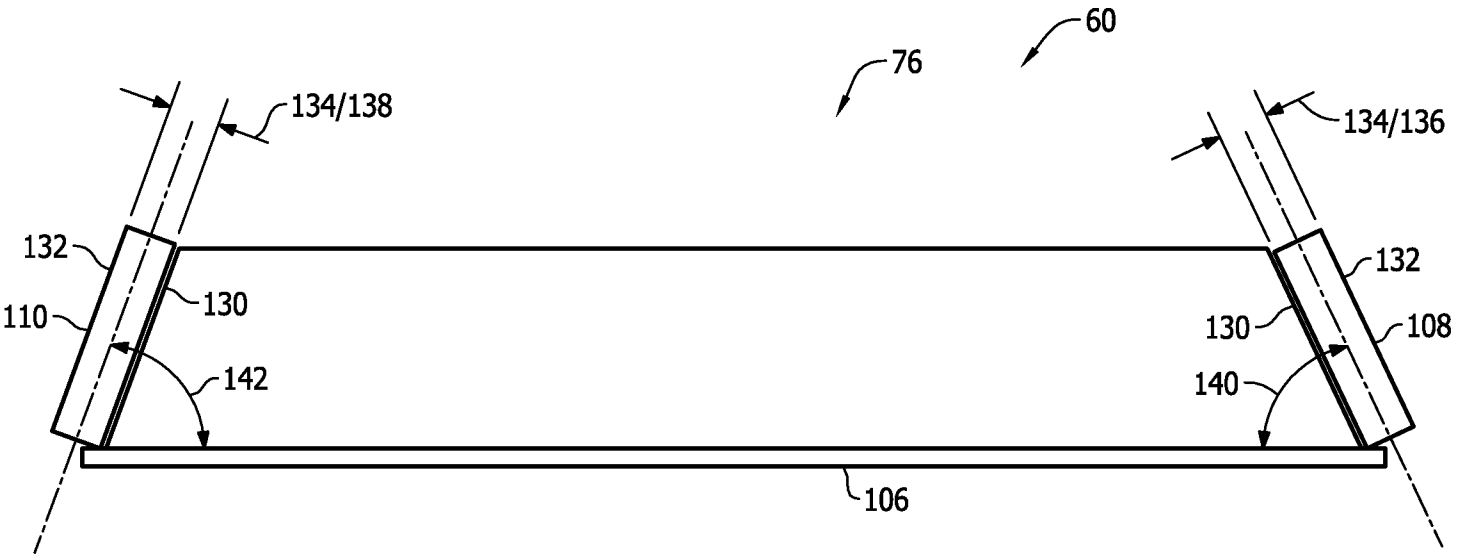
FIG. 11 is a cross-sectional view of the roof panel shown in FIG. 6, and taken along line 11-11.
Figure 12:
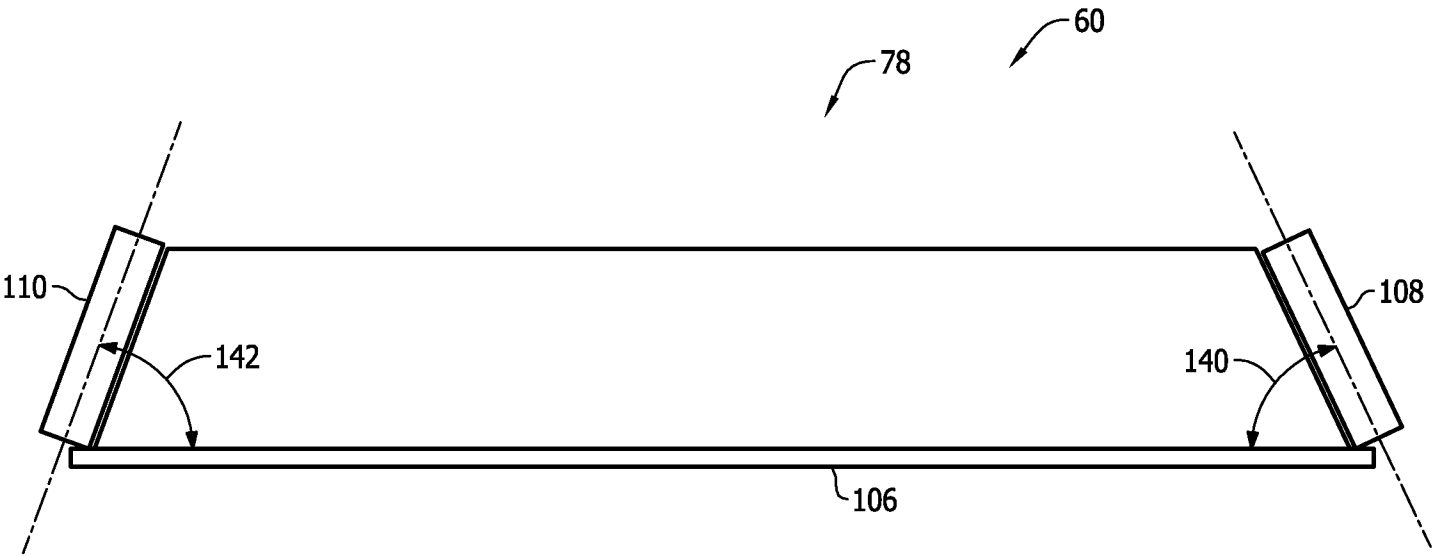
FIG. 12 is a cross-sectional view of the roof panel shown in FIG. 8, and taken along line 12-12.

FIG. 6 and FIG. 7 are schematic views of the primary roof panel 76. FIG. 11 is a cross-sectional view of the primary roof panel 76 taken along line 11-11 shown in FIG. 6. FIG. 8 is a schematic view of the secondary roof panel 78. FIG. 12 is a cross-sectional view of the secondary roof panel 78 taken along line 12-12 shown in FIG. 8. In the illustrated embodiment, each roof panel 60 includes a roof plate 106, an upper support beam 108 that is coupled to the roof plate 106, and a lower support beam 110 that is coupled to the roof plate 106. The roof plate 106 includes an inner surface 112, an outer surface 114, a forward edge 116, a rear edge 118, a first side edge 120 and an opposite second side edge 122. The inner surface 112 partially defines the interior volume 18. The side edges 120 and 122 each extend between the forward edge 116 and the rear edge 118 along the longitudinal axis 28, and the forward edge 116 and the rear edge 118 each extend between the side edges 120 and 122 along the transverse axis 30. The roof panel length 68 is measured between the forward edge 116 and the rear edge 118, and the roof panel width 74 is measured between the side edges 120 and 122 along the transverse axis 30.

The upper support beam 108 is coupled to the roof plate inner surface 112 and is orientated adjacent to the first side edge 120, and extends from the forward edge 116 towards the rear edge 118 along the longitudinal axis 28. The lower support beam 110 is coupled to the roof plate inner surface 112 and is orientated adjacent to the second side edge 122. The lower support beam 110 extends from the forward edge 116 towards the rear edge 118 and is orientated substantially parallel to the upper support beam 108. Each upper and lower support beams 108 and 110 is configured to transfer a load (not shown) from the roof plate 106 to the support frame 16. Each upper and lower support beam 108 and 110 includes a first end 124, a second end 126, and a length 128 measured between the first end 124 and the second end 126. In addition, each upper and lower support beam 108 and 110 includes an inner surface 130, an outer surface 132 and a thickness 134 measured between the inner and outer surfaces 130 and 134. In the illustrated embodiment, the upper support beam 108 includes a first thickness 136, and the lower support beam 110 includes a second thickness 138 that is approximately equal to the first thickness 136. Alternatively, the first thickness 136 may be less than, or greater than, the second thickness 138.

In the illustrated embodiment, the upper support beam 108 extends outwardly from the roof plate inner surface 112 at a first oblique angle 140 that is measured with respect to the roof plate inner surface 112. The first oblique angle 140 is selected to enable the upper support beam 108 to be coupled to the ridge beam 50 and/or a lower support beam 110 of an adjacent roof panel 60. The lower support beam 110 is coupled to the roof plate inner surface 112 and extends outwardly from the roof plate 106 at a second oblique angle 142 that is measured with respect to the roof plate inner surface 112. The second oblique angle 142 is selected to enable the lower support beam 110 to be coupled to a corresponding wall plate and/or an upper support beam 108 of an adjacent roof panel 60. In one embodiment, the upper support beam first oblique angle 140 may be different than the lower support beam second oblique angle 142. Alternatively, the first oblique angle 140 may be approximately equal to the second oblique angle 142.

Figure 9:
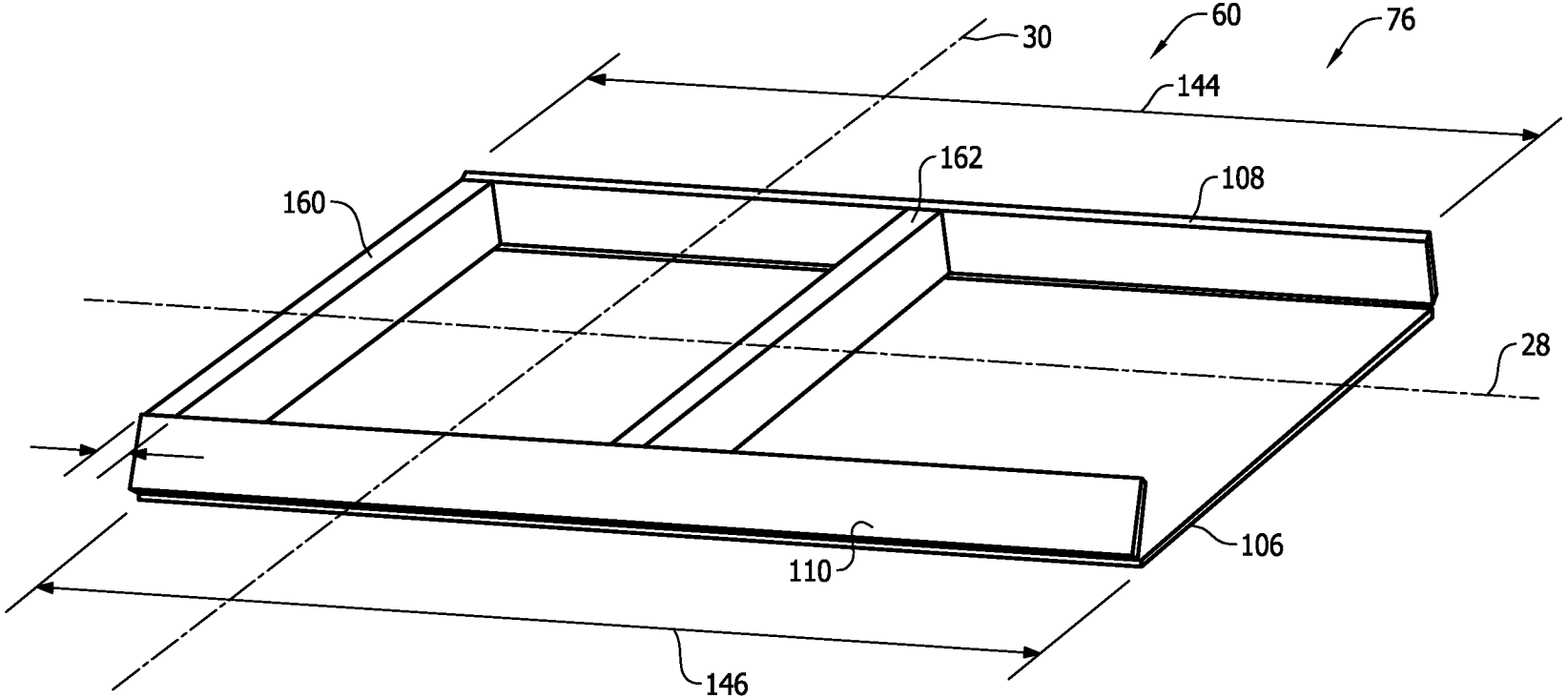
Figure 10:
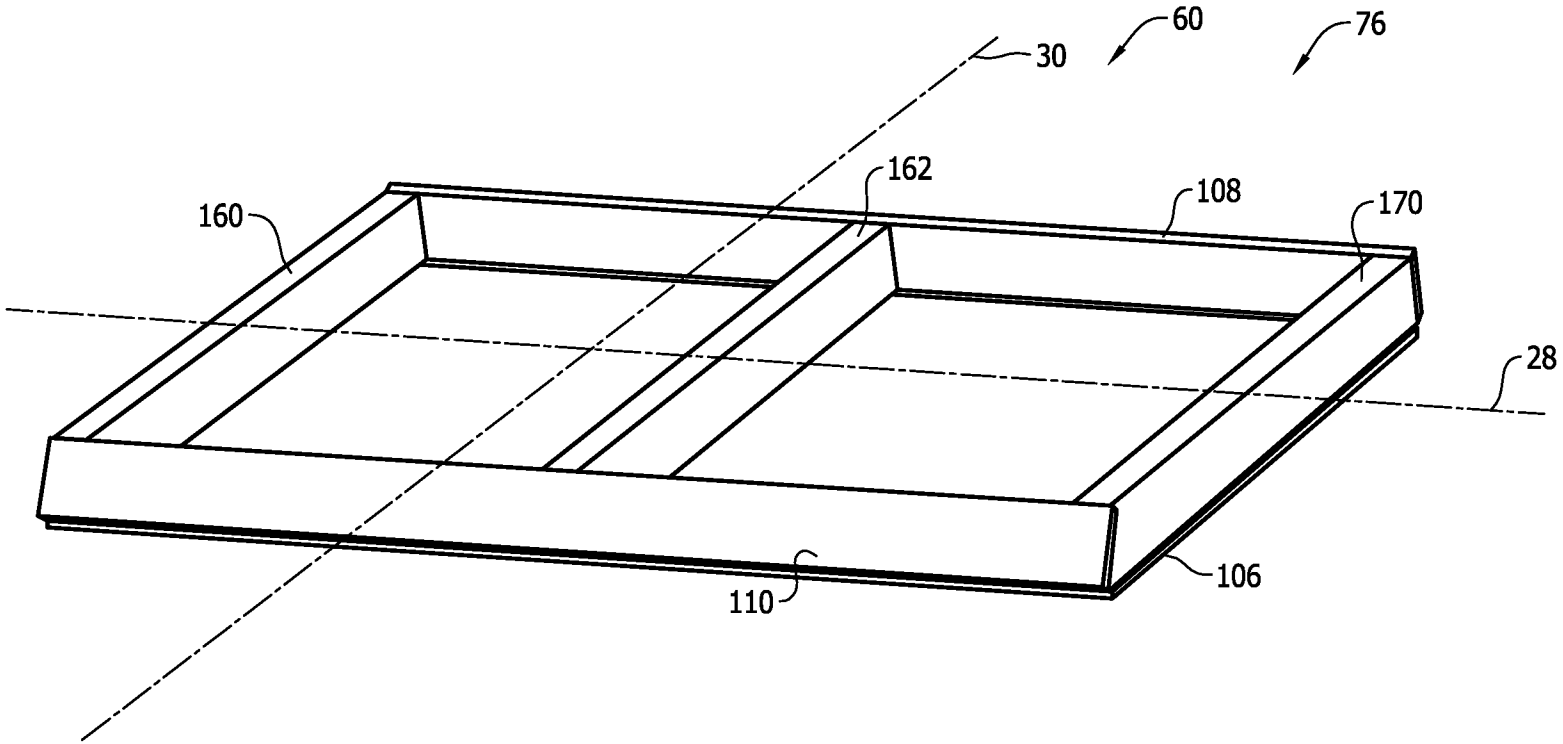

In one embodiment, the roof panel 60 includes an upper support beam 108 that has a first length 144, and a lower support beam 110 that has a second length 146 that is different than the first length 144. More specifically, the first end 124 of the upper support beam 108 is orientated adjacent to the roof plate forward edge 116 and the second end 126 is spaced a distance 148 from the roof plate rear edge 118 such that a gap 150 is defined between the rear edge 118 and the upper support beam 108. The gap 150 is sized and shaped to receive a portion of the roof support beam 54 therein such that the roof plate 106 overlaps a portion of the roof support beam 54 with the roof panel 60 coupled to the support frame 16. In one embodiment, the gap 150 may be defined between the upper support beam 108 and the forward edge 116. In another embodiment, the lower support beam 110 may be sized such that the gap 150 may be defined between the lower support beam 110 and the rear edge 118 and/or the forward edge 116. In one embodiment, and as shown in FIGS. 8-10, the roof panel 60 may include an upper support beam 108 having a first length 144 and a lower support beam 110 that has a second length 146 that is approximately equal to the first length 144. In addition, as shown in FIG. 4, the support frame 16 may include adjacent roof support beams 54 that are spaced a distance 152 apart such that an opening 154 is defined therebetween. The opening 154 is sized and shaped to receive a upper support beam 108 and/or a lower support beam 110 therein.

In the illustrated embodiment, the roof panel 60 includes at least one rafter member 156 that is coupled to the roof plate 106, the upper support beam 108, and the lower support beam 110. The rafter member 156 is configured to transfer a load (not shown), such as, for example, a roof panel weight and/or an environmental load, imparted on the roof plate 106 to the lower support beam 110 and/or the wall plate 42. The rafter member 156 extends between the upper support beam 108 and the lower support beam 110 and may be orientated substantially perpendicular to the upper support beam 108 and the lower support beam 110. The rafter member 156 includes a thickness 158 that is measured along the longitudinal axis 28.

In the illustrated embodiment, the roof panel 60 includes a first rafter member 160 that is orientated adjacent to the roof plate forward edge 116 and a second rafter member 162 that is spaced a distance from the first rafter member 160 along the longitudinal axis 28. In one embodiment, the first rafter member 160 has a first thickness 164, and the second rafter member 162 has a second thickness 166 that is approximately equal to the first thickness 164. Alternatively, the first thickness 164 may be greater than, or less than, the second thickness 166.

Referring to FIGS. 6-8, in the illustrated embodiment, the primary roof panel 76 includes a first rafter member 160 that is orientated adjacent to the forward edge 116 and a second rafter member 162 that is orientated adjacent to a mid-span location 168 of the roof plate 106 along the longitudinal axis 28. The secondary roof panel 78 includes a first rafter member 160 that is orientated adjacent to the forward edge 116 and a second rafter member 162 that is orientated adjacent to the rear edge 118. In one embodiment, as shown in FIG. 10, the roof panel 60 may include a first rafter member 160 that is orientated adjacent to the forward edge 116, a second rafter member 162 that is orientated adjacent to the mid-span location 168, and a third rafter member 170 that is orientated adjacent to the rear edge 118.

Figure 15:
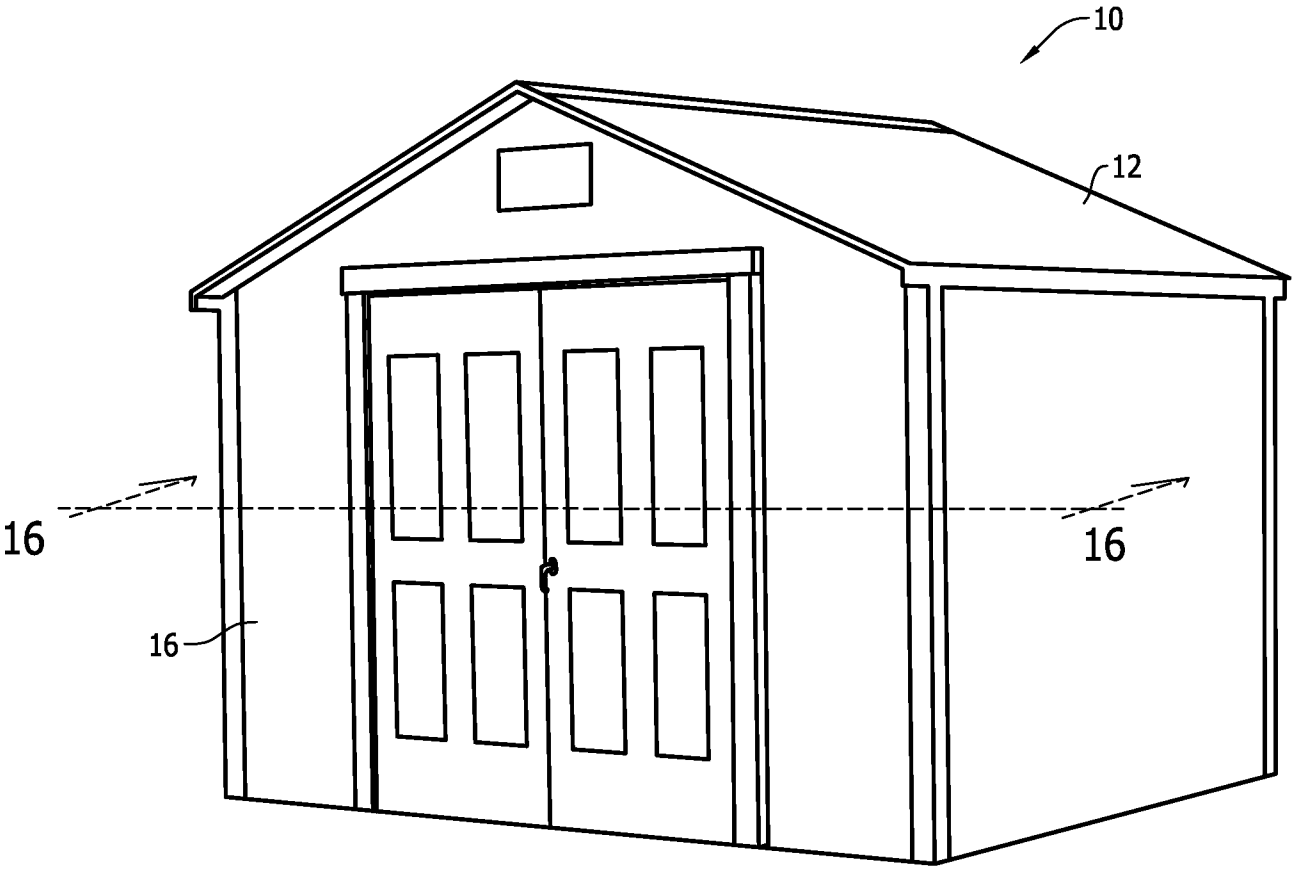
FIG. 15 is a perspective view of another embodiment of the portable storage building shown in FIG. 1, according to an embodiment of the present invention.
Figure 16:
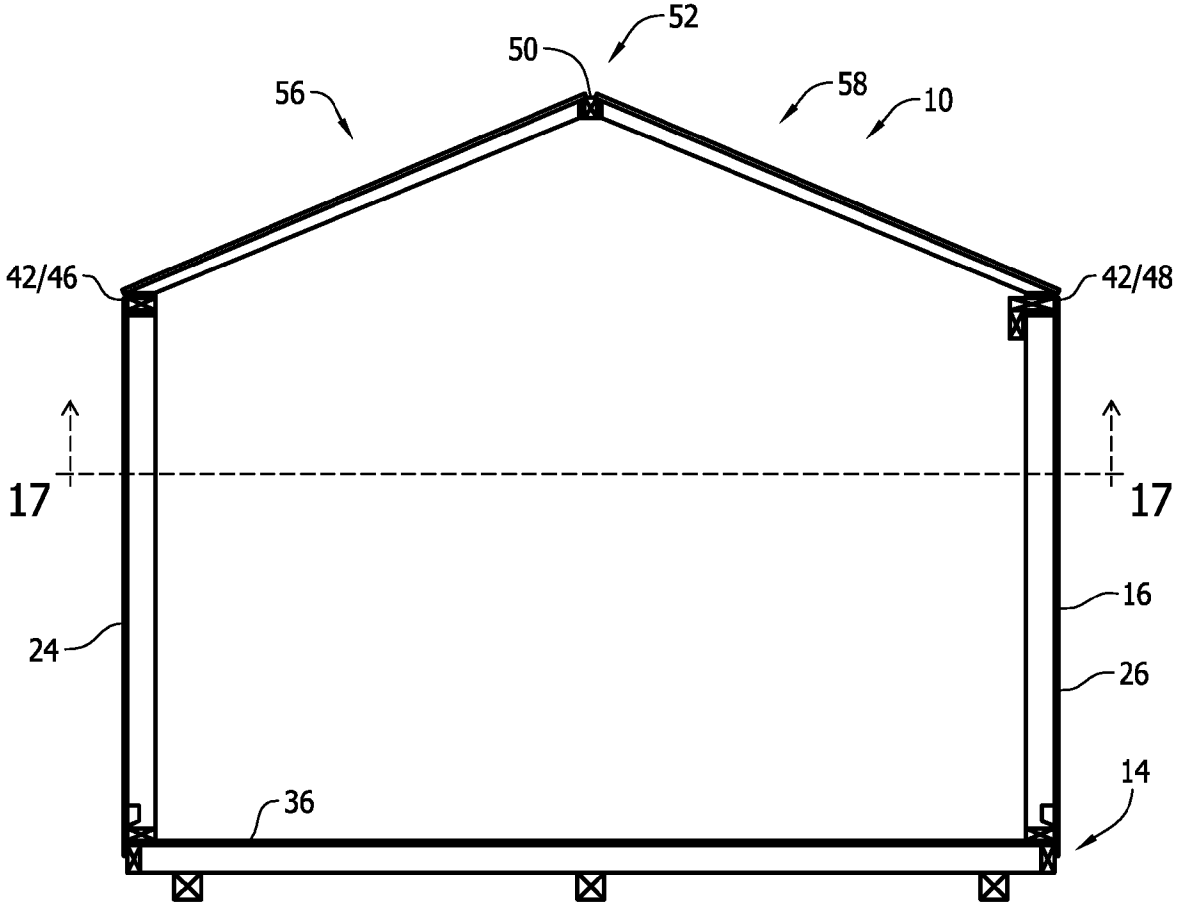
FIG. 16 is a schematic view of the portable storage building shown in FIG. 15, and taken along line 16-16.
Figure 17:
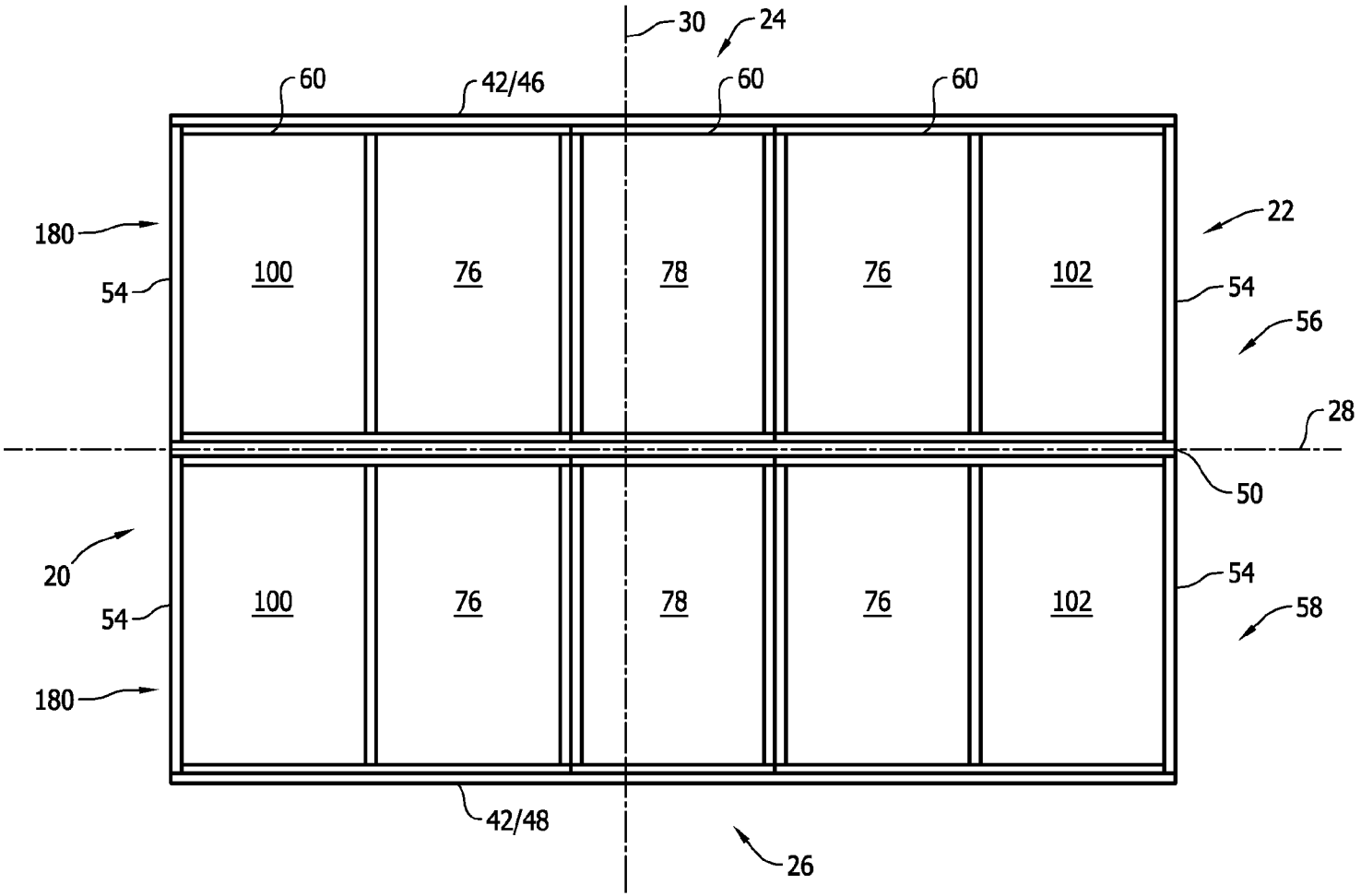
FIG. 17 is a schematic view of a roof panel system that may be used with the portable storage building shown in FIG. 16, and taken along the line 17-17, according to an embodiment of the present invention.
Figure 18:
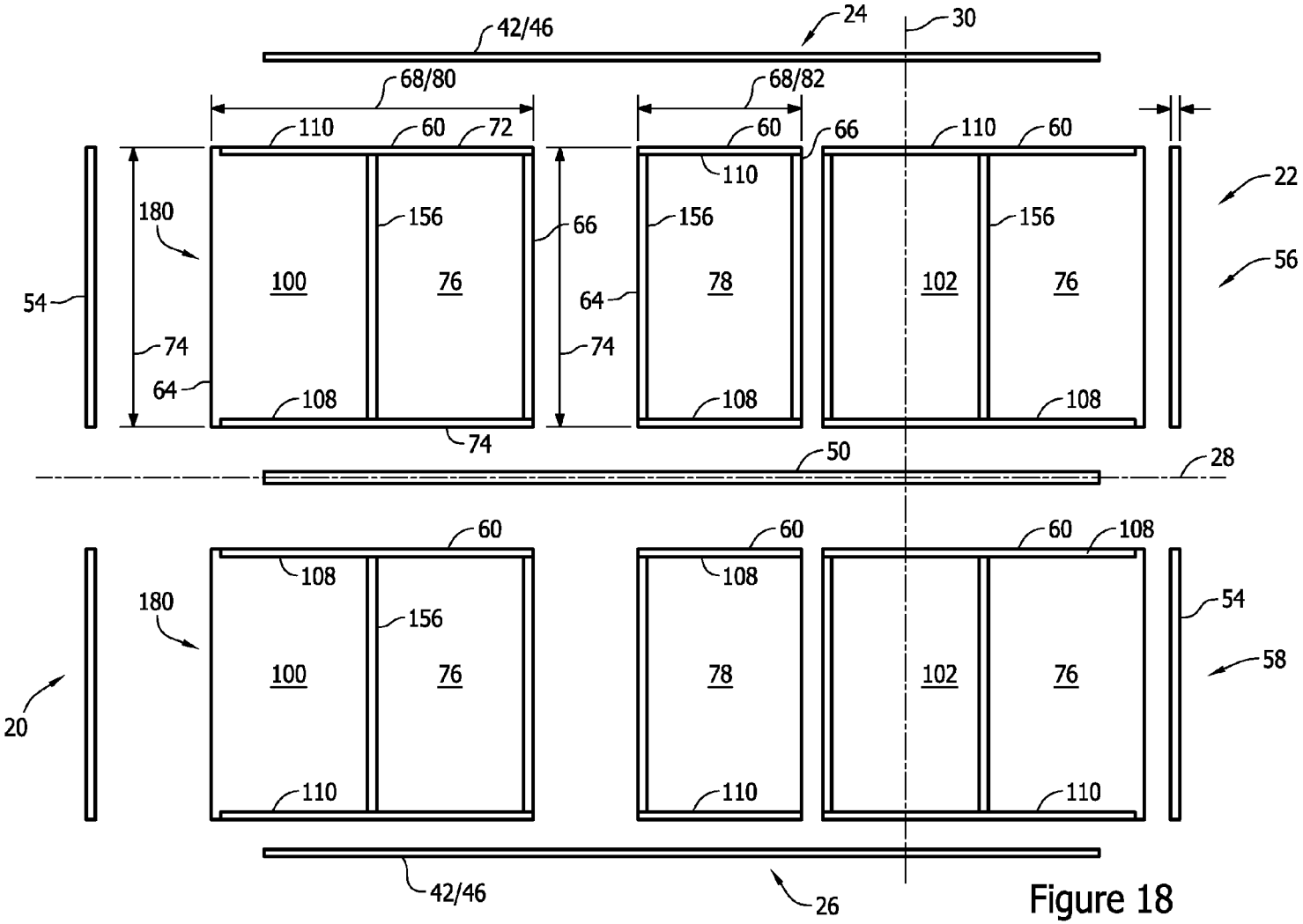
FIG. 18 is an exploded schematic view of the roof panel system shown in FIG. 17.

FIG. 15 is a perspective view of another embodiment of the portable storage building 10 in which similar reference numbers are used for similar components. FIG. 16 is a schematic view of the portable storage building 10 taken along line 16-16 shown in FIG. 15. FIG. 17 is a schematic view of the roof panel system 12 taken along the line 17-17 shown in FIG. 16, and FIG. 18 is an exploded schematic view of the roof panel system 12 as is shown in FIG. 17. In the illustrated embodiment, the roof panel system 12 includes the first panel assembly 56 and the second panel assembly 58. The first panel assembly 56 includes a row 180 of roof panels 60 that are coupled together along the longitudinal axis 28 to form the first panel assembly 56. Each roof panel 60 extends between the ridge beam 50 and the first wall plate 46 such that the upper support beam 108 of each roof panel 60 is coupled to the ridge beam 50, and the lower support beam 110 of each roof panel 60 is coupled to the first wall plate 46. Similarly, the second panel assembly 58 includes a row 180 of roof panels 60 that are coupled between the ridge beam 50 and the second wall plate 48.

In the illustrated embodiment, the first and second panel assemblies 56 and 58 each include a first primary roof panel 100, and a second primary roof panel 102, and a secondary roof panel 78 that is coupled between the first and second primary roof panels 100 and 102.

Figure 19:
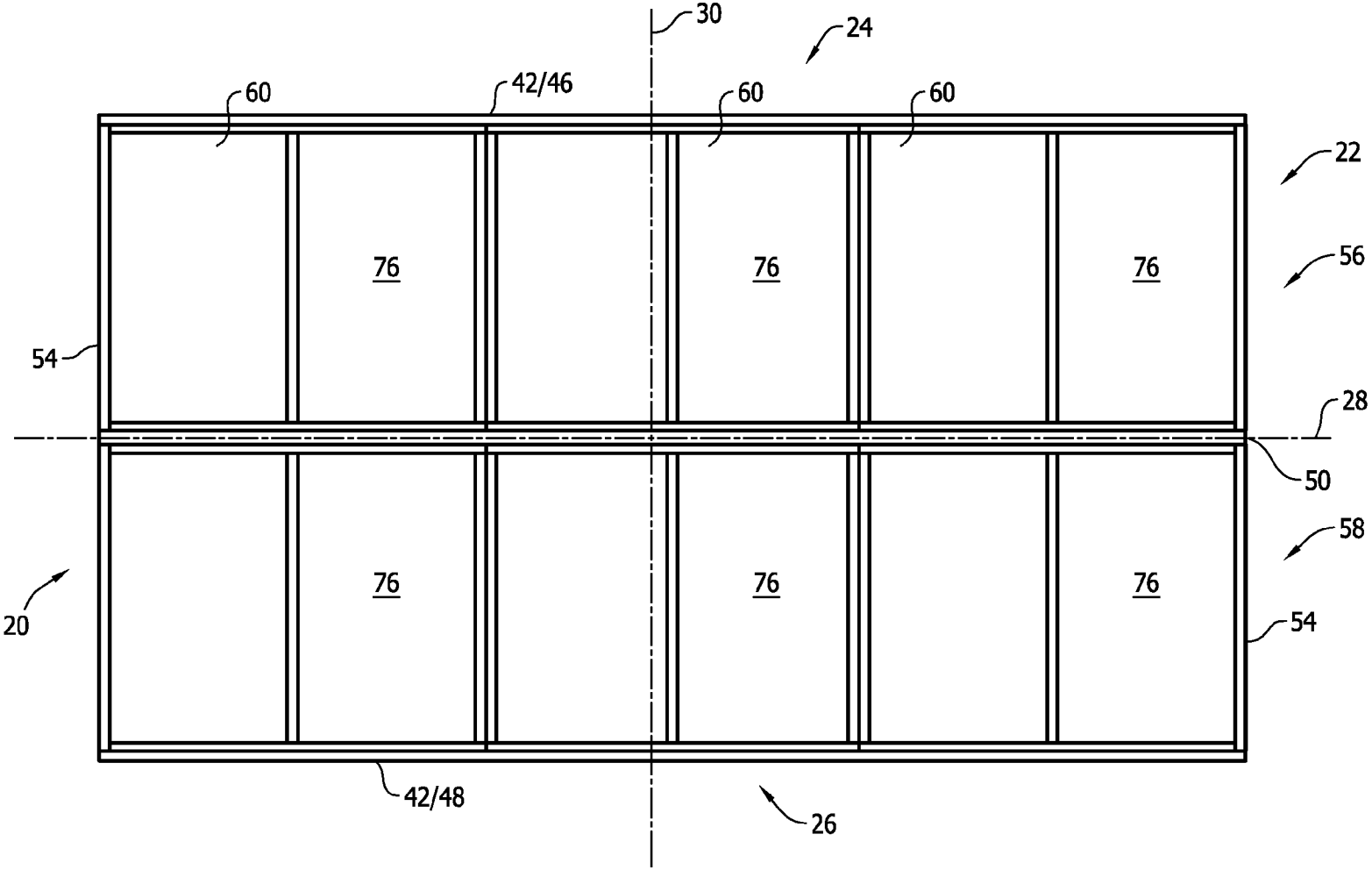
FIG. 19 is schematic view of another embodiment of the roof panel system shown in FIG. 17, according to an embodiment of the present invention.
Figure 20:
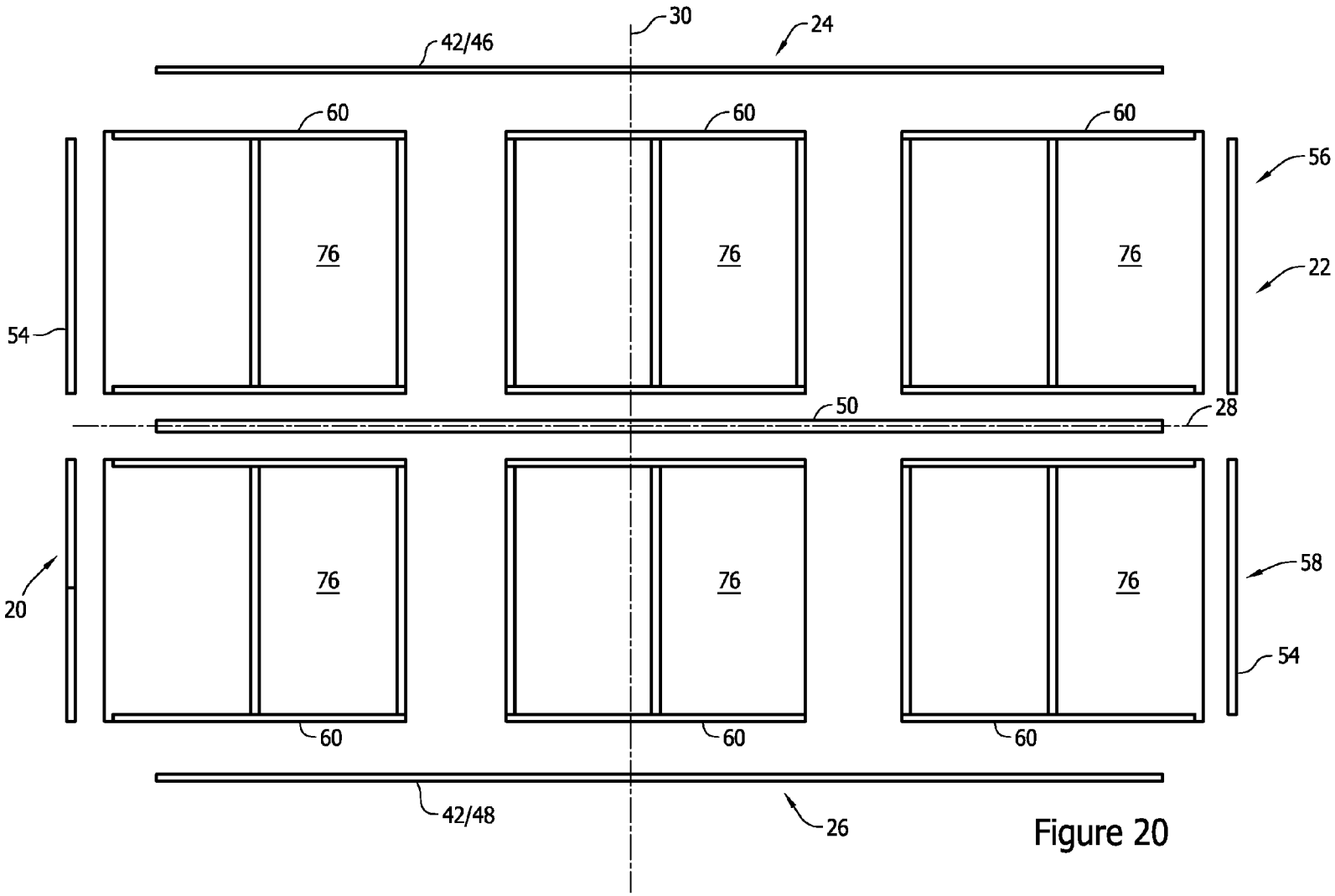
FIG. 20 is an exploded schematic view of the roof panel system shown in FIG. 19.

FIG. 19 is a schematic view of another embodiment of the roof panel system 12. FIG. 20 is an exploded schematic view of the roof panel system 12 as is shown in FIG. 19. In the illustrated embodiment, each first and second panel assemblies 56 and 58 include 3 primary roof panels 76 that are coupled together along the longitudinal axis 28 to form the corresponding first and second roof panel assemblies 56 and 58.

In the illustrated embodiment, the roof panels 60 and support frame 16 are at least partially formed from wood building materials. In another embodiment, the roof panels 60, ridge beam 50, and support frame 16 may include aluminum, plastic, rubber, steel, metal alloy, and/or any suitable building materials that enable the portable storage building 10 to function as described herein.

The above-described system, apparatus, and method overcome at least some disadvantages of known storage buildings by providing a portable storage building having a roof panel system that includes a plurality of modular roof panels that are adapted to be coupled together to form the building roof. More specifically, each roof panel has a predefined size and shape and is adapted to be coupled to adjacent roof panels to enable a consumer to assemble the building roof on-site. By providing a portable storage building with a roof panel system that can be assembled by the consumer, the manpower required to assemble the portable building is reduced. As a result, the overall cost of the portable storage building is reduced.

Exemplary embodiments of a storage building and a roof panel system for use with storage buildings are described above in detail. The system, apparatus, and methods are not limited to the specific embodiments described herein, but rather, components of the system, apparatus and/or methods may be utilized independently and separately from other components and/or steps described herein. For example, the roof panel system may also be used in combination with other portable storage buildings, and are not limited to practice with only the portable storage buildings as described herein. Rather, the exemplary embodiment can be implemented and utilized in connection with many other portable storage building applications.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of assembling a portable building including a roof panel system, the portable building including a support frame including a first end wall, a second end wall, a first wall plate, an opposite second wall plate, and a ridge beam positioned above the first and second wall plates, the ridge beam and the first and second wall plates extending between the first end wall and the second end wall along a longitudinal axis, the roof panel system adapted to be coupled to the building support frame, the method comprising the steps of:

providing a plurality of pre-assembled, modular roof panels, each roof panel adapted to be coupled to at least one of the building support frame and adjacent roof panels to form the roof panel system;

providing a roof plate for use in forming a roof panel of the plurality of roof panels, the roof plate having a forward edge, a rear edge, a first side edge and an opposite second side edge, each of the first and second side edges extending between the forward edge and the rear edge, the roof panel having a length measured between the forward edge and the rear edge along a longitudinal axis;

coupling an upper support beam to the roof plate, the upper support beam orientated adjacent to the first side edge and extending from the forward edge towards the rear edge along the longitudinal axis; and coupling a lower support beam to the roof plate to form the roof panel, the lower support beam orientated adjacent to the second side edge and extending from the forward edge towards the rear edge substantially parallel to the upper support beam, the lower support beam extending outwardly from the roof plate at an oblique angle to facilitate coupling the lower support beam to the corresponding wall plate.

2. A method in accordance with claim 1, further comprising the steps of:

coupling the upper support beam to the roof plate at a first oblique angle measured with respect to the roof plate; and coupling the lower support beam to the roof plate at a second oblique angle measured with respect to the roof plate.

3. A method in accordance with claim 1, further comprising the step of:

coupling a first rafter member between the upper support beam and the lower support beam, the first rafter member positioned adjacent to the roof plate forward edge.

4. A method in accordance with claim 3, further comprising the step of coupling a second rafter member between the upper support beam and the lower support beam, the second rafter member orientated adjacent to a mid-span location of the roof plate.

5. A method in accordance with claim 3, further comprising the step of coupling a second rafter member between the upper support beam and the lower support beam, the second rafter member orientated adjacent to the roof plate rear edge.

6. A method in accordance with claim 1, wherein the upper support beam has a first length measured along the longitudinal axis and the lower support beam has a second length measured along the longitudinal axis that is different than the first length.

7. A roof panel system for use with a portable building, the portable building including a support frame including a first end wall, a second end wall, a first wall plate, an opposite second wall plate, and a ridge beam positioned above the first and second wall plates, the ridge beam and the first and second wall plates extending between the first end wall and the second end wall along a longitudinal axis, the roof panel system comprising:

a first panel assembly adapted to be coupled between the ridge beam and the first wall plate; and, a second panel assembly adapted to be coupled between the ridge beam and the second wall plate, each of the first and second panel assemblies including a plurality of pre-assembled, modular roof panels that are adapted to be coupled together to form the first panel assembly and second panel assembly, respectively, each first panel assembly and second panel assembly being adapted to extend between the first end wall and the second end wall, each of the plurality of roof panels including an upper support beam, a lower support beam, and a roof plate coupled to each of the upper and the lower support beams, at least one of the roof panels including a lower support beam adapted to be coupled to a corresponding wall plate, the lower support beam extending outwardly from the roof plate at an oblique angle to facilitate coupling the lower support beam to the corresponding wall plate.

8. A roof panel system in accordance with claim 7, wherein each of the roof panels includes:

the roof plate including a forward edge, a rear edge, a first side edge and an opposite second side edge, each of the first and second side edges extending between the forward edge and the rear edge, the roof panel having a length measured between the forward edge and the rear edge along the longitudinal axis;

the upper support beam orientated adjacent to the first side edge and extending from the forward edge towards the rear edge along the longitudinal axis; and the lower support beam orientated adjacent to the second side edge and extending from the forward edge towards the rear edge substantially parallel to the upper support beam.

9. A roof panel system in accordance with claim 8, wherein the upper support beam extends outwardly from the roof plate at a first oblique angle measured with respect to the roof plate, the lower support beam extending outwardly from the roof plate at a second oblique angle measured with respect to the roof plate.

10. A roof panel system in accordance with claim 9, wherein the upper support beam first angle is different than the lower support beam second angle.

11. A roof panel system in accordance with claim 8, wherein each roof panel includes at least one rafter member coupled between the upper support beam and the lower support beam, the at least one rafter member orientated substantially perpendicular to the upper and lower support beams.

12. A roof panel system in accordance with claim 11, wherein at least one roof panel includes a first rafter member orientated adjacent to the roof plate forward edge and a second rafter member orientated adjacent to a mid-span location of the roof plate.

13. A roof panel system in accordance with claim 11, wherein at least one roof panel includes a first rafter member orientated adjacent to the roof plate forward edge and a second rafter member orientated adjacent to the roof plate rear edge.

14. A roof panel system in accordance with claim 8, further comprising a first roof panel and a second roof panel, each first and second roof panels adapted to be coupled between the ridge beam and the wall plate, the first roof panel adapted to be coupled to the second roof panel such that the first roof panel is positioned between the second roof panel and the first end wall along the longitudinal axis.

15. A roof panel system in accordance with claim 14, wherein the first roof panel has a first length and the second roof panel has a second length that is approximately equal to the first length.

16. A roof panel system in accordance with claim 14, wherein the first roof panel has a first length and the second roof panel has a second length that is less than the first length.

17. A roof panel system in accordance with claim 16, wherein the first length is approximately twice as long as the second length.

18. A roof panel system in accordance with claim 8, wherein the at least one roof panel of the plurality of roof panels includes the upper support beam having a first length measured along the longitudinal axis, and the lower support beam having a second length measured along the longitudinal axis that is different than the first length.

19. A roof panel system in accordance with claim 18, wherein the first end wall includes a roof support beam, the at least one roof panel comprises an upper support beam having a first end and a second end, the first end orientated adjacent to the roof plate forward edge, the second end spaced a distance from the rear edge such that a gap is defined between the second end and the rear edge, the gap being sized to receive the roof support beam therein such that the roof plate overlaps a portion of the roof support beam.

20. A roof panel system in accordance with claim 7, wherein the upper support beam is adapted to be coupled to the ridge beam.

21. A roof panel system in accordance with claim 8, wherein each first and second roof panel assemblies includes a first set of roof panels and a second set of roof panels, the first set of roof panels adapted to be coupled to the ridge beam and extending outwardly from the ridge beam at a first angle, the second set of roof panels adapted to be coupled between the first set of roof panels and the corresponding wall plate, the second set of roof panels extending outwardly from the first set of roof panels at a second angle that is different from the first angle.

22. A portable storage building, comprising:

a support frame including a first end wall, a second end wall, a first wall plate, an opposite second wall plate, and a ridge beam positioned above the first and second wall plates, the ridge beam and the first and second wall plates extending between the first end wall and the second end wall along a longitudinal axis; and, a roof panel system coupled to the support frame including:

a first panel assembly coupled between the ridge beam and the first wall plate; and a second panel assembly coupled between the ridge beam and the second wall plate, each of the first and second panel assemblies including a plurality of pre-assembled, modular roof panels that are coupled together to form the first panel assembly and the second panel assembly, respectively, each first panel assembly and second panel assembly extending between the first end wall and the second end wall, each of the plurality of roof panels including an upper support beam, a lower support beam, and a roof plate coupled to each of the upper and the lower support beams, at least one of the roof panels including a lower support beam coupled to a corresponding wall plate, the lower support beam extending outwardly from the roof plate at an oblique angle to facilitate coupling the lower support beam to the corresponding wall plate.

23. A portable storage building in accordance with claim 22, wherein each of the roof panels comprises:

the roof plate including a forward edge, a rear edge, a first side edge and an opposite second side edge, each of the first and second side edges extending between the forward edge and the rear edge, the roof panel having a length measured between the forward edge and the rear edge along the longitudinal axis;

the upper support beam orientated adjacent to the first side edge and extending from the forward edge towards the rear edge along the longitudinal axis; and, the lower support beam orientated adjacent to the second side edge and extending from the forward edge towards the rear edge substantially parallel to the upper support beam.

24. A portable storage building in accordance with claim 23, wherein the upper support beam extends outwardly from the roof plate at a first oblique angle measured with respect to the roof plate, the lower support beam extending outwardly from the roof plate at a second oblique angle measured with respect to the roof plate.

25. A portable storage building in accordance with claim 24, wherein the upper support beam first angle is different than the lower support beam second angle.

26. A portable storage building in accordance with claim 23, wherein each roof panel includes at least one rafter member coupled between the upper support beam and the lower support beam, the at least one rafter member orientated substantially perpendicular to the upper and lower support beams.

27. A portable storage building in accordance with claim 26, wherein at least one roof panel includes a first rafter member orientated adjacent to the roof plate forward edge and a second rafter member orientated adjacent to a mid-span location of the roof plate.

28. A portable storage building in accordance with claim 26, wherein at least one roof panel includes a first rafter member orientated adjacent to the roof plate forward edge and a second rafter member orientated adjacent to the roof plate rear edge.

29. A portable storage building in accordance with claim 23, wherein the roof panel system comprises a first roof panel and a second roof panel, each first and second roof panels coupled between the ridge beam and the wall plate, the first roof panel coupled to the second roof panel such that the first roof panel is positioned between the second roof panel and the first end wall along the longitudinal axis.

30. A portable storage building in accordance with claim 29, wherein the first roof panel has a first length and the second roof panel has a second length that is approximately equal to the first length.

31. A portable storage building in accordance with claim 30, wherein the first roof panel has a first length and the second roof panel has a second length that is less than the first length.

32. A portable storage building in accordance with claim 31, wherein the first length is approximately twice as long as the second length.

33. A portable storage building in accordance with claim 23, wherein the least one roof panel of the plurality of roof panels comprises the upper support beam having a first length measured along the longitudinal axis, and the lower support beam having a second length measured along the longitudinal axis that is different than the first length.

34. A portable storage building in accordance with claim 33, wherein the first end wall includes a roof support beam, the at least one roof panel comprising an upper support beam having a first end and a second end, the first end orientated adjacent to the roof plate forward edge, the second end spaced a distance from the rear edge such that a gap is defined between the second end and the rear edge, the gap being sized to receive the roof support beam therein such that the roof plate overlaps a portion of the roof support beam.

35. A portable storage building in accordance with claim 7, wherein the upper support beam is coupled to the ridge beam.

36. A portable storage building in accordance with claim 23, wherein each first and second roof panel assemblies includes a first set of roof panels and a second set of roof panels, the first set of roof panels coupled to the ridge beam and extending outwardly from the ridge beam at a first angle, the second set of roof panels coupled between the first set of roof panels and the corresponding wall plate, the second set of roof panels extending outwardly from the first set of roof panels at a second angle that is different from the first angle.

* * * * *